United States Patent [19]

Mammino et al.

[11] Patent Number: 4,515,882

[45] Date of Patent: May 7, 1985

[54] OVERCOATED ELECTROPHOTOGRAPHIC IMAGING SYSTEM

[75] Inventors: Joseph Mammino, Penfield; Donald S. Sypula; Dennis A. Abramsohn, both of Pittsford; Martin A. Abkowitz, Webster; Merlin E. Scharfe, Penfield, all of N.Y.

[73] Assignee: Xerox Corporation, Stamford, Conn.

[21] Appl. No.: 567,840

[22] Filed: Jan. 3, 1984

[51] Int. Cl.[3] ..... G03G 5/14

[52] U.S. Cl. ..... 430/58; 430/59; 430/66; 430/900

[58] Field of Search ..... 430/58, 59, 66, 900

[56] References Cited

U.S. PATENT DOCUMENTS 3,954,464 5/1976 Karam et al. ..... 430/67 X 4,256,821 3/1981 Enomoto et al. ..... 430/59

*Primary Examiner*—John D. Welsh

*Attorney, Agent, or Firm*—Peter H. Kondo; John E. Beck; Ronald Zibelli

[57] ABSTRACT

An electrophotographic imaging system utilizing a member comprising at least one photoconductive layer and an overcoating layer comprising a film forming continuous phase comprising charge transport molecules and finely divided charge injection enabling particles dispersed in the continuous phase, the insulating overcoating layer being substantially transparent to activating radiation to which the photoconductive layer is sensitive and substantially electrically insulating at low electrical fields.

15 Claims, 6 Drawing Figures

OVERCOATED ELECTROPHOTOGRAPHIC IMAGING SYSTEM

BACKGROUND OF THE INVENTION

This invention relates to electrophotography and more particularly, to an improved overcoated electrophotographic imaging member and method of using the electrophotographic imaging member.

Generally, electrophotographic imaging processes involve the formation and development of electrostatic latent images on the imaging surface of a photoconductive member. The photoconductive member is usually imaged by uniformly electrostatically charging the imaging surface in the dark and exposing the member to a pattern of activating electromagnetic radiation such as light, to selectively dissipate the charge in the illuminated areas of the member to form an electrostatic latent image on the imaging surface. The electrostatic latent image is then developed with a developer composition containing toner particles which are attracted to the photoconductive member in image configuration. The resulting toner image is often transferred to a suitable receiving member such as paper.

The photoconductive members include single or multiple layered devices comprising homogeneous or heterogeneous inorganic or organic compositions and the like. One example of a photoconductive member containing a heterogeneous composition is described in U.S. Pat. No. 3,121,006 wherein finely divided particles of a photoconductive inorganic compound is dispersed in an electrically insulating organic resin binder. The commercial embodiment usually comprises a paper backing containing a coating thereon of a binder layer comprising particles of zinc oxide uniformly dispersed therein. Useful binder materials disclosed therein include those which are incapable of transporting for any significant distance injected charge carriers generated by the photoconductive particles. Thus, the photoconductive particles must be in substantially contiguous particle to particle contact throughout the layer for the purpose of permitting charge dissipation required for cyclic operation. Thus, about 50 percent by volume of photoconductive particles is usually necessary in order to obtain sufficient photoconductive particle to particle contact for rapid discharge. These relatively high photoconductive concentrations can adversely affect the physical continuity of the resin binder and can significantly reduce the mechanical strength of the binder layer.

Other known photoconductive compositions include amorphous selenium, halogen doped amorphous selenium, amorphous selenium alloys including selenium arsenic, selenium tellurium, selenium arsenic antimony, halogen doped selenium alloys, cadmium sulfide and the like. Generally, these inorganic photoconductive materials are deposited as a relatively homogeneous layer on suitable conductive substrates. Some of these inorganic layers tend to crystallize when exposed to certain vapors that may occasionally be found in the ambient atmosphere. Moreover, the surfaces of selenium type photoreceptors are highly susceptible to scratches which print out in final copies.

Still other electrophotographic imaging members known in the art comprise a conductive substrate having deposited thereon an organic photoconductor such as a polyvinylcarbazole-2,4,7-trinitrofluorenone combination, phthalocyanines, quinacridones, pyrazolones and the like. Some of these photoreceptors, such as those containing 2,4,7-trinitrofluorenone, present health or safety issues Recently, there has been disclosed layered photoresponsive devices comprising photogenerating layers and transport layers deposited on conductive substrates as described, for example, in U.S. Pat. No. 4,265,990 and overcoated photoresponsive materials containing a hole injecting layer, a hole transport layer, a photogenerating layer and a top coating of an insulating organic resin, as described, for example, in U.S. Pat. No. 4,251,612. Examples of photogenerating layers disclosed in these patents include trigonal selenium and various phthalocyanines and hole transport layers containing certain diamines dispersed in inactive polycarbonate resin materials. The disclosures of each of these patents, namely, U.S. Pat. Nos. 4,265,990 and 4,251,612 are incorporated herein by reference in their entirety. Other representative patents containing layered photoresponsive devices include U.S. Pat. Nos. 3,041,116; 4,115,116; 4,047,949 and 4,081,274. These patents relate to systems that require negative charging for hole transporting layers when the photogenerating layer is beneath the transport layer. Photogenerating layers overlying hole transport layers require positive charging but must be equal to or less than about 1 to 2 micrometers for adequate sensitivity and therefore wear away quite rapidly.

While the above described electrophotographic imaging members may be suitable for their intended purposes, there continues to be a need for improved devices. For example, the imaging surface of many photoconductive members is sensitive to wear, ambient fumes, scratches and deposits which adversely affect the electrophotographic properties of the imaging member.

Overcoating layers have been proposed to overcome the undesirable characteristics of uncoated photoreceptors. However, many of the overcoating layers adversely affect electrophotographic performance of an electrophotographic imaging member. One type of overcoating material that has been described in the prior art is electrically insulating. For example, an insulating overcoating containing an organic high polymer and Lewis acid is described in U.S. Pat. No. 4,225,648. This overcoating may also contain other additives such as pigment, dye and hardener. An insulating overcoating containing the combination of a resin and an organic aluminum compound is described in U.S. Pat. No. 3,966,471. Apparently, the organic aluminum compound reacts with the resin to promote transfer of toner images to the receiving member. In U.S. Pat. No. 4,191,568, an insulating overcoating containing a resin and certain electron donor compounds with or without electronic acceptor compounds are mentioned. When an electrically insulating overcoating layer is employed, the thickness must be quite thin to permit discharge of the photoreceptor during exposure to activating radiation and image configuration. Further, there is a tendency for a residual charge to remain on the surface of the insulating overcoating layer after exposure. The residual voltage level intensifies as the thickness of the insulating coating is increased. This causes undesirably high background deposits in the final toner image. Moreover, scratches on imaging surfaces tend to be printed out due to the electrical differences between the scratched areas and the unscratched areas. Attempts have been made to minimize these problems by making the insulating coating as thin as possible. However, thin coatings are difficult to uniformly deposit and are subject to rapid wear. As the overcoating wears and changes in thickness, the imaging characteristics of the photoreceptor also change since charge density is dependent upon thickness.

Attempts have also been made to overcome the deficiencies of overcoating layers by employing overcoating material which is less insulating to prevent electric charge from accumulating on or in the overcoating layer. Conductive overcoatings have been disclosed containing aromatic diamines. For example, the aromatic diamine is combined with an organic halogen capable of producing a free halogen in U.S. Pat. No. 4,293,630; with an organic proton acid in copending U.S. patent application Ser. No. 142,198, entitled Electrophotgraphic Photosensitive Member, filed Apr. 21, 1980 in the name of K. Oka; and with a salt having a oxidizing ability in U.S. patent application Ser. No. 142,167, entitled Electrophotgraphic Photosensitive Member, filed Apr. 21, 1980 in the name of K. Oka. Examples of prior art additives used to render protective overcoatings conductive including carbon black, metal powder, tetra-ammonium salt and the like are mentioned in the introduction of U.S. Pat. No. 4,191,568. Conductive overcoatings containing a resin and a metal oxide particles are revealed in co-pending U.S. patent application Ser. No. 322,792, entitled Process For Forming An Electrophotgrahic Member Having a Protective Layer, filed Nov. 19, 1981 in the name of K. Oka. The use of a blocking layer to trap charge at the interface between the conductive overcoating layer and the underlying photoconductive layer is disclosed in many of these conductive overcoating cases. The protective layer may also be made less insulating by incorporating appropriate materials such as quaternary ammonium salts or the like in the overcoating layer. However, the conductivity of such materials varies greatly due to the absorption of ambient moisture. Moreover, under very dry conditions, the conductivity of this type of overcoating layer is reduced to the extent that charge will accumulate on the outer surface of the overcoating layer with the attendant adverse effects described above with respect to insulating layers. Under humid conditions, the charge migration tends to occur laterally resulting in blurred images.

An overcoating containing a charge transport layer formed from linoleic acid and ethylene diamine is taught in U.S. Pat. No. 3,713,820. Electron acceptor compounds may be added to form a charge transfer complex thereby increasing the coating conductivity. An overcoating containing a resin and a metallocene is taught in U.S. Pat. No. 4,315,980. It appears that at least some of the resins form a charge transfer complex with ferrocene. Moreover, an electron acceptor may also be added to the overcoating layer. Further, a thin intermediate layer may be provided below the protective layer to improve electrical characteristics. The overcoatings of U.S. Pat. Nos. 3,713,820 and 4,315,980 exhibit a change in electrical conductivity by reacting with corona generated oxidizing compounds formed during charging.

While some of the above-described imaging members exhibit certain desirable properties such as protecting the surface of an underlying photoconductive layer, there continues to be a need for improved overcoating layers for protecting photographic imaging members.

SUMMARY OF THE INVENTION

In accordance with the present invention, there is provided electrophotographic imaging member having at least one photoconductive layer and an overcoating layer comprising an insulating film forming continuous phase comprising charge transport molecules and finely divided charge injection enabling particles dispersed in the continuous phase. Where desired, a barrier layer may be interposed between the photoconductive layer and the overcoating layer. This electrophotographic imaging member can be employed in an electrophotographic imaging process in which the outer imaging surface of the overcoating layer is uniformly charged in the dark, a sufficient electric field is applied across the electrophotographic imaging member to polarize the charge injection enabling particles whereby the charge injection enabling particles inject charge carriers into the overcoating layer, the charge carriers are transported to and trapped at the interface between the photoconductive layer and the overcoating layer, and opposite space charge in the overcoating layer is relaxed by charge emission from the charge injection enabling particles to the imaging surface. The overcoating layer is essentially electrically insulating prior to the deposition of the uniform electrostatic charge on the imaging surface.

BRIEF DESCRIPTION OF THE DRAWINGS

A more complete understanding of the process and device of the present invention can be obtained by reference to the accompanying drawings wherein.

Figure 1:
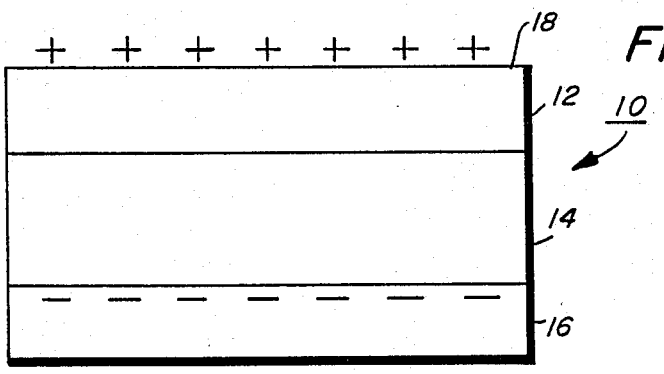
FIG. 1 graphically illustrates the location of charges when a photoreceptor is overcoated with an insulating layer.

Any suitable insulating film forming binder having a very high dielectric strength and good electrically insulating properties may be used in the continuous charge transporting phase of the overcoating of this invention. The binder itself may be a charge transporting material or one capable of holding transport molecules in solid solution or as a molecular dispersion. A solid solution is defined as a composition in which at least one component is dissolved in another component and which exists as a homogeneous solid phase. A molecular dispersion is defined as a composition in which particles of at least one component are dispersed in another component, the dispersion of the particles being on a molecular scale. Typical film forming binder materials that are not charge transporting material include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-alkyd resins, and the like.

Any suitable film forming polymer having charge transport capabilities may be used as a binder in the continuous phase of the overcoating of this invention. Binders having charge transport capabilities are substantially nonabsorbing in the spectral region of intended use, but are "active" in that they are capable of transporting charge carriers injected by the charge injection enabling particles in an applied electric field. The charge transport binder may be a hole transport film forming polymer or an electron transport film forming polymer. Charge transporting film forming polymers are well known in the art. A partial listing representative of such charge transporting film forming polymers includes the following:

Polymeric binders polymers prepared from diphenyl diamines as disclosed, for example, in copending U.S. patent application Ser. No. 215,610, entitled Process For Preparing Arylamines, filed Dec. 12, 1980 in the name of J. F. Yanus et al, triphenyl methane polyamines and the like.

Polyvinylcarbazole and derivatives of Lewis acids described in U.S. Pat. No. 4,302,521.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717.

Other transport materials such as poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, B 1,3-dibromo-poly-N-vinyl carbazole and 3,6-dibromo-poly-N-vinyl carbazole and numerous other transparent organic polymeric transport materials as described in U.S. Pat. No. 3,870,516.

The disclosures of each of the patents and pending patent application identified above pertaining to binders having charge transport capabilities are incorporated herein in their entirety.

The film forming binder should have an electrical resistivity at least about $10^{13}$ ohm-cm. It should be capable of forming a continuous film and be substantially transparent to activating radiation to which the underlying photoconductive layer is sensitive. In other words, the transmitted activating radiation should be capable of generating charge carriers, i.e. electron-hole pairs in the underlying photoconductive layer or layers. A transparency range of between about 10 percent and about 100 percent can provide satisfactory results depending upon the specific photoreceptors utilized. A transparency of at least about 50 percent is preferred for greater speed with optimum speeds being achieved at a transparency of at least 80 percent.

Any suitable charge transport molecule capable of acting as a film forming binder or which is soluble or dispersible on a molecular scale in a film forming binder may be utilized in the continuous phase of the overcoating of this invention. The charge transport molecule should be capable of transporting charge carriers injected by the charge injection enabling particles in an applied electric field. The charge transport molecules may be hole transport molecules or electron transport molecules. Where the charge transport molecule is capable of acting as a film forming binder as indicated above, it may if desired, be employed to function as both an insulating binder for the charge injection enabling particles and as the continuous charge transporting phase without the necessity of incorporating a different charge transport molecule in solid solution or as a molecular dispersion therein. Charge transporting materials are well known in the art. In addition to the film forming polymers having charge transport capabilities listed above, a partial listing representative of non film forming charge transporting materials include the following:

Diamine transport molecules of the types described in U.S. Pat. Nos. 4,306,008, 4,304,829, 4,233,384, U.S. Pat. No. 4,115,116, U.S. Pat. No. 4,299,897, U.S. Pat. No. 4,265,990 and U.S. Pat. No. 4,081,274. Typical diamine transport molecules include N,N'-diphenyl-N,N'-bis(alkylphenyl)-[1,1'-biphenyl]-4,4'-diamine wherein the alkyl is, for example, methyl, ethyl, propyl, n-butyl, etc. such as N,N'-diphenyl-N,N'-bis(3''-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, U.S. Pat. No. 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)-pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and others described in German Pat. Nos. 1,058,836, 1,060,260 and 1,120,875 and U.S. Pat. No. 3,895,944.

A preferred hydrazone is one having the general formula:

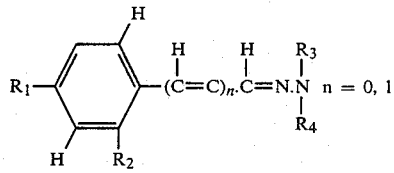

wherein $R_1$ is

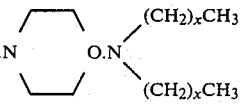

x = 0, 1, 2, 3, or

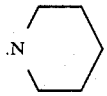

wherein $R_2$ is $.OCH_2CH_3$, $.CH_3$, or .H, wherein $R_3$ is

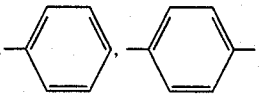

$CH_3$, $.CH_3$ or $CH_2CH_2CH_3$, and wherein $R_4$ is

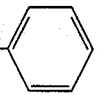

, or $.CH_3$.

Typical examples of hydrazone transport molecules encompassed by this formula include p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example in U.S. Pat. No. 4,385,106, U.S. Pat. No. 4,338,388, U.S. Pat. No. 4,387,147, U.S. Pat. No. 4,399,208, U.S. Pat. No. 4,399,207.

Another preferred charge transport molecule is a carbazole phenyl hydrazone having the general formula:

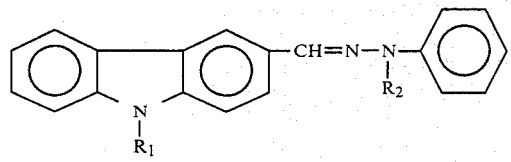

wherein $R_1$ represents methyl, ethyl, 2-hydroxyethyl, or 2-chloroethyl group and $R_2$ represents methyl, ethyl, benzyl or phenyl group.

Typical examples of transport molecules encompassed by this formula include 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described, for example, in U.S. Pat. No. 3,820,989.

9-fluorenylidene methane derivatives having the formula:

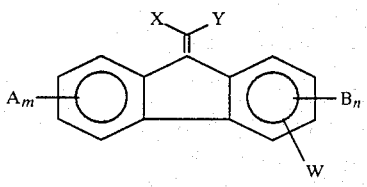

wherein X and Y are cyano groups or alkoxycarbonyl groups, A, B, and W are electron withdrawing groups independently selected from the group consisting of acyl, alkoxycarbonyl, nitro, alkylaminocarbonyl and derivatives thereof, m is a number of from 0 to 2, and n is the number 0 or 1 as described in copending U.S. patent application Ser. No. 521,198, entitled Layered Photoresponsive Device, filed on Aug. 8, 1983. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other typical transport materials include the numerous transparent organic non-polymeric transport materials described in U.S. Pat. No. 3,870,516 and the nonionic compounds described in U.S. Pat. No. 4,346,157.

The disclosures of each of the patents and pending patent application identified above pertaining to charge transport molecule which are soluble or dispersible on a molecular scale in a film forming binder are incorporated herein in their entirety.

Other transport material such as poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric or non-polymeric transport materials as described in U.S. Pat. No. 3,870,516.

When the charge transport molecules are combined with an insulating film forming binder, the amount of charge transport molecule which is used may vary depending upon the particular charge transport material and its compatibility (e.g. solubility in the continuous insulating film forming binder phase of the overcoating layer) and the like. Satisfactory results have been obtained using the proportions normally used to form the charge transport medium of photoreceptors containing a charge transport component and a charge generating component. Proportions normally used to form the charge transport medium of photoreceptors containing a charge transport component and a charge generating component are described in the partial listing above.

When overcoating layers are prepared with only insulating film forming binder and charge transport molecules in solid solution or molecular dispersion in the film forming binder, the overcoating layer remains insulating after charging until at least the image exposure step. However, when sufficient charge injection enabling particles are dispersed in an overcoating layer containing an insulating film continuous phase capable of transporting charge carriers, the overcoating layer acquires the capability of being an insulator until a sufficient electric field is applied to polarize the charge injection enabling particles whereby the charge injection enabling particles inject charge carriers into the continuous phase of the overcoating layer, allow the charge carriers to be transported to and be trapped at the interface between the underlying photoconductive layer and the overcoating layer, and opposite space charge in the overcoating layer is relaxed by charge emission from the charge injection enabling particles to the outer imaging surface of the overcoating. Any suitable organic or inorganic charge injection enabling particle may be utilized in the overcoating of this invention. The charge injection enabling particles may be hole injection enabling particles or electron injection enabling particles. Any particle can function as a charge injection enabling particle as long as the concentration of the particles and the entire electric field are sufficient to cause the charge injection enabling particles to rapidly polarize and inject charge carriers into the continuous phase of the overcoating layer. Generally, the charge injection enabling particles have an electrical resistivity of about $10^{12}$ ohm cm or less to be charge injection enabling. Typical inorganic charge injection enabling particles include carbon black, molybdenum disulfide, silicon, tin oxide, antimony oxide, chromium dioxide, zinc oxide, titanium oxide, magnesium oxide, manganese dioxide, aluminum oxides, other metal oxides, colloidal silica, colloidal silica treated with silanes, graphite, tin, aluminum, nickel, steel, silver, gold, other metals, their oxides, sulfides, halides and other salt forms, and the like.

Typical examples of organic charge injection enabling particles are fluorinated carbon particles; phthalocyanine pigment particles; quinacridone pigment particles; conductive complexes of tetracyanoquinodimethane with polymeric quaternary ammonium salts, poly(2-vinylpyridene), poly(4-vinylpyridene), poly(N-vinyl imidazole), poly(4-dimethylaminostyrene), and ionene polymers; black brominated poly(cyclopentadiene); polymeric reaction product of poly(alkyl vinyl ketones) with phosphoryl chloride; metal polyphthalocyanines; a tetranitrile formed from tetracyanoethylene solution phase deposited on metal surfaces at about 200° C.; the trans isomer of polyacetylene prepared by exposure of acetylene to films of concentrated solutions of a Ziegler-Natta catalyst $[Ti(OC_4Hg\text{-}n)_4\text{-}Al(C_2H_5)_3]$; poly(p-phenylene oxide); polypyrrole formed by the electrolysis of pyrrole; poly(2,5-thienylene); conductive polymers formed by pyrolysis of poly(phenylacetylene), polyynes (pyrolyzed at 200°-600° C.), poly(acylacetylene) (pyrolyzed at 400°-870° C.), polymeric Schiff Base (pyrolyzed at 500° C.), and polyaminoquinone (pyrolyzed at 500° C.); $Cu2^{+}Ni(S_2C_2(CN)_2)_2^{2-}$; copper tetracyanoquinodimethane; potassium tetracyanoquinodimethane; sodium tetracyanoquinodimethane; lithium tetracyanoquinodimethane; complex of anthracene with tetracyanoquinodimethane; complex of pyrene with tetracyanoquinodimethane; polystyrene sulphonic acid with a high degree of sulfonation (Versa-TL 72, available from National Starch and Chemical Corporation); other organic pigment particles; and the like.

The particle size of the charge injection enabling particles should be less than about 45 micrometers but preferably should be less than about 10 micrometers and less than the wavelength of light utilized to rapidly expose the underlying photoconductive layers. In other words the particle size should be sufficient to maintain the overcoating layer substantially transparent to the wavelength of light to which the underlying photoconductive layer or layers are sensitive. A particle size between about 100 Angstroms and about 500 Angstroms has been found suitable for light sources having a wavelength greater than about 4,000 Angstroms. Generally, the overcoating layer should contain at least about 0.1 percent by weight of the charge injection enabling particles based on the total weight of the overcoating layer. At lower concentrations, a noticable residual charge tends to form, which at lower levels, can be compensated during development by applying an electric bias as is well known in the art. The upper limit for the amount of the charge injection enabling particles to be used depends upon the relative quantity of charge flow desired through the overcoating layer, but should be less than that which would reduce the transparency of the overcoating to a value less than about 10 percent and which would render the overcoating too conductive. Satisfactory results have been obtained with the concentration of charge injection enabling particles as high as 50 percent by weight based on the total weight of the overcoating layer for silica particles, a relatively poor charge injection enabling material, dispersed in polycarbonate resin containing dissolved N,N'-diphenyl-N,N'-bis(3-methylphenyl) 1,1'-biphenyl-4,4'-diamine, a charge transport molecule. In the absence of the charge transport molecule, an overcoating layer of 50 percent by weight based on the total weight of the overcoating layer for silica particles dispersed in polycarbonate resin remained an insulator in an applied electric field. The concentration of charge injection enabling particles should be considerably less than 50 percent by weight based on the total weight of the overcoating layer if efficient and highly conductive charge injection enabling particles are utilized. For example, the overcoating layer becomes undesirably electrically conductive in an applied field when the silica particles are replaced by a concentration of 50 percent by weight carbon black charge injection enabling particles based on the total weight of the overcoating layer, dispersed in polycarbonate resin containing dissolved N,N'-diphenyl-N,N'-bis(3-methylphenyl) 1,1'-biphenyl-4,4'-diamine. Generally, a sufficient concentration of charge injection enabling particles is present when the charge injection enabling particles instantly polarize in the dark in less than about $10^{-12}$ second and inject charge carriers into the continuous phase in less than about 10 microseconds in an electric field greater than about 5 volts per micrometer applied across the overcoating layer and the photoconductive layer or when the charge injection enabling particles polarize in the dark in more than about $10^{-2}$ second and inject charge carriers into the continuous phase in more than about 10 microseconds in an electric field less than about 5 volts per micrometer applied across the overcoating layer and the photoconductive layer. Thus charge injection enabling particles polarize in less than about $10^{-12}$ second and inject charge carriers into the continuous charge transporting phase in less than about 10 microseconds when an applied electric field of between about 5 volts per micrometer and about 80 volts per micrometer is applied in the dark across the imaging member from the conductive substrate to the outer surface of the overcoating and forms a residual voltage on the protective overcoating of less than about 10 to about 250 volts per micrometer. The electric field may be applied by any suitable charging technique. Typical charging techniques include corona charging, brush charging, stylus charging, contact charging and the like.

The components of the overcoating layer may be mixed together by any suitable conventional means. Typical mixing means include stirring rods, ultrasonic vibrators, magnetic stirrers, paint shakers, sand mills, roll pebble mills, sonic mixers, melt mixing devices and the like. It is important, however, that if the insulating film forming binder is a different material than the charge transport molecules, the charge transport molecules must either dissolve in the insulating film forming binder or be capable of being molecularly dispersed in the insulating film forming binder. A solvent or solvent mixture for the film forming binder and charge transport molecules may be utilized if desired. Preferably, the solvent or solvent mixture should dissolve both the insulating film forming binder and the charge transport molecules. The solvent selected should not adversely affect the underlying photoreceptor. For example, the solvent selected should not dissolve or crystallize the underlying photoreceptor.

The overcoating mixture may be applied to the photoconductive member or to a blocking layer, if a blocking layer is utilized. The overcoating mixture may be applied by any suitable well known technique. Typical coating techniques include spraying, draw bar coating, dip coating, gravure coating, silk screening, air knife coating, reverse roll coating, extrusion techniques and the like. Any suitable conventional drying or curing technique may be utilized to dry the overcoating. The drying or curing conditions should be selected to avoid damaging the underlying photoreceptor. For example, the overcoating drying temperatures should not cause crystallization of amorphous selenium when an amorphous selenium photoreceptor is used.

The thickness of the overcoating layer after drying or curing may be between about 1 micrometer and about 15 micrometers. Generally, overcoating thicknesses less than about 1 micrometer fail to provide sufficient protection for the underlying photoreceptor. Greater protection is provided by an overcoating thickness of at least about 3 micrometers. Resolution of the final toner image begins to degrade when the overcoating thickness exceeds about 15 micrometers. Clearer image resolution is obtained with an overcoating thickness less than about 8 micrometers. Thus, an overcoating thickness of between 3 micrometers and about 8 micrometers is preferred for optimum protection and image resolution.

The final dried or cured overcoating should be substantially insulating prior to charging. Satisfactory results may be achieved when the final overcoating has a resistivity at least about $10^{13}$ ohm-cm at fields low enough to essentially eliminate injection from the charge injection enabling particles into the transport molecule. More specifically, the overcoating is substantially electrically insulating in the dark and the charge injection enabling particles with therefore not polarize in less than about $10^{-12}$ second and inject charge carriers into the continuous charge transporting phase in less than about 10 microseconds when an applied electric field less than about 5 volts per micrometer is applied across the imaging member from the conductive substrate to the outer surface of the overcoating. The final dried or cured overcoating should also be substantially non-absorbing in the spectral region at which the underlying photoconductive layer or layers are sensitive. The expression "substantially non-absorbing" is defined as a transparency of between about 10 percent and about 100 percent in the spectral region at which the underlying photoconductive layer or layers are sensitive. A transparency of at least about 50 percent in the spectral region at which the underlying photoconductive layer or layers are sensitive is preferred for greater speed with optimum speeds being acheived at a transparency of at least 80 percent.

If desired, a blocking layer may be utilized between the overcoating layer and the underlying photoconductive layer or layers. The blocking layer is particularly desirable for positively charged electrophotographic imaging members where the charge transport molecule is a hole transport molecule. Any suitable blocking layer capable of trapping charge carriers that are transported through the overcoating layer to the interface between the overcoating layer and the underlying photoconductive layer and which has an electrical resistivity greater than the overcoating layer may be utilized. Typical blocking layers include polyvinylbutyral, organosilanes, epoxy resins, polyesters, polyamides, polyurethanes, vinylidene chloride resin, silicone resins, fluorocarbon resins and the like containing an organo metallic salt. Additional typical blocking layer materials include selenium, selenium arsenic alloys and halogen doped selenium arsenic alloys as disclosed in U.S. Pat. No. 4,338,387 and U.S. Pat. No. 4,286,033; nitrogen containing siloxanes or nitrogen containing titanium compounds such as trimethoxysilyl propylene diamine, hydrolyzed trimethoxysilyl propyl ethylene diamine, N-beta(aminoethyl) gamma-amino-propyl trimethoxy silane, isopropyl 4-aminobenzene sulfonyl, di(dodecylbenzene sulfonyl) titanate, isopropyl di(4-aminobenzoyl) isostearoyl titanate, isopropyl tri(N-ethylaminoethylamino) titanate, isopropyl trianthranil titanate, isopropyl tri(N,N-dimethyl-ethylamino) titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. No. 4,291,110; metal acetylacetonate compounds such as titanium acetylacetonate, aluminum tris(acetylacetonate), iron tris(acetylacetonate), cobalt bis(acetylacetonate), copper bis(acetylacetonate), magnesium bis(acetylacetonate), manganese (II) bis(acetylacetonate), nickel (II) bis(acetylacetonate), vanadium tris(acetylacetonate), zinc bis(acetylacetonate), tin bis(acetylacetonate), metal alcoholates such as aluminum isopropylate, mono-sec-butoxy aluminum diisopropylate, aluminum sec-butyrate, ethylacetoacetate aluminum diisopropylate, vanadium ethylate, vanadium n-propylate, vanadium isobutyrate, titanium orthoesters such as tetramethyl orthotitanate, tetraethyl orthotitanate, tetra-n-propyl orthotitanate, tetraisopropyl orthotitanate, tetrabutyl orthotitanate, tetraiso butyl orthotitanate, tetracresyl titanate, tetrastearyl titanate, tetra-2-ethylhexyl titanate, tetranonyl titanate, tetracetyl titanate, isopropyl triisostearoyl titanate, isopropyl tridodecylbenzenesulfonyl titanate, isopropyl tris(dioctylpyrophosphate) titanate, titanium chelates such as diisopropoxy titanium bis(octanediol), diisopropoxy titanium bis(hexanediol), diisopropoxy titanium bis(acetylacetonate), titanium tetralactate, tetraisopropyl bis(dioctylphosphyte) titanate, tetraoctyl bis(ditridecylphosphyte) titanate, tetra(2,2-diallyloxymethyl-1-butyl)bis(ditridecylphosophyte), bis(dioctylpilophsophate) oxyacetate titanate, tris(dioctylpylophosphate) ethylene titanate, and other suitable organotitanium compounds disclosed, for example, in UK Patent Application GB No. 2106659 A published Apr. 3, 1983. The disclosures of U.S. Pat. Nos. 4,338,387, 4,286,033 and 4,291,110 and UK Patent Application GB No 2106659 A are incorporated herein in their entirety. Other similar organometallic salts of metals other than titanium may be used for blocking layers. These other metals are transition elements from the first and second transition series as defined by F. Albert Cotton and Geoffrey Wilkinson, "Advanced Inorganic Chemistry", 4th edition, pages 619–621. Examples of these organometallic salts of metals other than titanium include zirconium acetylacetonate, zirconium n-propoxide, zirconium n-butoxide, zirconium tetra-n-butyrate, zirconium tetrakisacetylacetonate, and the like. The blocking layer should be continuous and have a thickness of less than about 0.2 micrometers because greater thicknesses may lead to undesirably high residual voltage. A blocking layer of between about 0.05 micrometer and about 0.15 micrometer is preferred because charge neutralization after the exposure step is facilitated and adequate electrical performance is achieved.

The blocking layer may be applied by any suitable conventional technique such as spraying, dip coating, draw bar coating, gravure coating, silk screening, air knife coating, reverse roll coating, vacuum deposition and the like.

For convenience in obtaining thin layers, the blocking layers are preferably applied in the form of a dilute solution, with the solvent being removed after deposition of the coating by conventional techniques such as by vacuum, heating and the like. Generally, a weight ratio of blocking layer material and solvent of between about 0.05:100 and about 0.5:100 is satisfactory for spray coating.

Any suitable electrophotoconductive member may be overcoated with the overcoating layer of this invention. Generally, an electrophotoconductive member comprises one or more photoconductive layers on a supporting substrate. The substrate may be opaque or substantially transparent and may comprise numerous suitable materials having the required mechanical properties. Accordingly, this substrate may comprise a layer of a non-conductive or conductive material such as an inorganic or an organic composition. If the substrate comprises non-conductive material, it is usually coated with a conductive composition. An insulating non-conducting materials there may be employed various resins known for this purpose including polyesters, polycarbonates, polyamides, polyurethanes, and the like. The insulating or conductive substrate may be flexible or rigid and may have any number of many different configurations such as, for example, a plate, a cylindrical drum, a scroll, an endless flexible belt, and the like. Preferably, the insulating substrate is in the form of an endless flexible belt and is comprised of a commercially available polyethylene terephthalate polyester known as Mylar available from E. I. du Pont de Nemours & Co.

The thickness of the substrate layer depends on numerous factors, including economical considerations, and thus this layer may be of substantial thickness, for example, over 200 microns, or of minimum thickness less than 50 microns, provided there are no adverse affects on the final photoconductive device. In one embodiment, the thickness of this layer ranges from about 65 microns to about 150 microns, and preferably from about 75 microns to about 125 microns.

A conductive layer or ground plane which may comprise the entire support or be present as a coating on a non-conductive layer may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member. Accordingly, the conductive layer can generally range in thickness of from about 50 Angstrom units to many centimeters. When a flexible photoresponsive imaging device is desired, the thickness may be between about 100 Angstrom units to about 750 Angstrom units, and more preferably from about 100 Angstrom units to about 200 Angstrom units.

Any suitable photoconductive layer or layers may be overcoated with the overcoating layer of this invention. The photoconductive layer or layers may be inorganic or organic. Typical inorganic photoconductive materials include well known materials such as amorphous selenium, selenium alloys, halogen-doped selenium alloys such as selenium-tellurium, selenium-tellurium-arsenic, selenium-arsenic, and the like, cadmium sulfoselenide, cadmium selenide, cadmium sulfide, zinc oxide, titanium dioxide and the like. Typical organic photoconductors include phthalocyanines, quinacridones, pyrazolones, polyvinylcarbazole-2,4,7-trinitrofluorenone, anthracene and the like. Many organic photoconductors may be used as particles dispersed in a resin binder.

Any suitable multilayer photoconductors may also be employed with the overcoating layer of this invention. The multilayer photoconductors comprise at least two electrically operative layers, a photogenerating or charge generating layer and a charge transport layer. Examples of photogenerating layers include trigonal selenium, various phthalocyanine pigments such as the X-form of metal free phthalocyanine described in U.S. Pat. No. 3,357,989, metal phthalocyanines such as copper phthalocyanine, quinacridones available from DuPont under the tradename Monastral Red, Monastral violet and Monastral Red Y, substituted 2,4-diamino-triazines disclossed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange. Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and copending application entitled "Layered Photoresponsive Imaging Devices," U.S. Ser. No. 466,764, filed in the names of Leon A. Teuscher, Frank Y. Pan and Ian D. Morrison on Feb. 15, 1983; dyestuff generator layer and oxadiazole, pyrazalone, imidazole, bromopyrene, nitrofluourene and nitronaphthalimide derivative containing charge transport layers members disclosed in U.S. Pat. No. 3,895,944; generator layer and hydrazone containing charge transport layers members disclosed in U.S. Pat. No. 4,150,987; generator layer and a tri-aryl pyrazoline compound containing charge transport layer members disclosed in U.S. Pat. No. 3,837,851; and the like. The disclosures of these patents and application are incorporated herein in their entirety.

A preferred multilayered photoconductor comprises a charge generation layer comprising a layer of photoconductive material and a contiguous charge transport layer of a polycarbonate resin material having a molecular weight of from about 20,000 to about 120,000 having dispersed therein from about 25 to about 75 percent by weight of one or more compounds having the general formula:

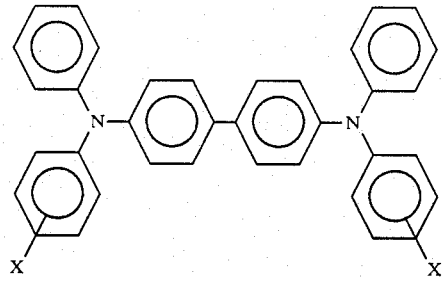

wherein X is selected from the group consisting of an alkyl group, having from 1 to about 4 carbon atoms and chlorine, said photoconductive layer exhibiting the capability of photogeneration of holes and injection of said holes and said charge transport layer being substantially non-absorbing in the spectral region at which the photoconductive layer generates and injects photogenerated holes but being capable of supporting the injection of photogenerated holes from said photoconductive layer and transporting said holes through said charge transport layer. Other examples of charge transport layers capable of supporting the injection of photogenerated holes of a charge generating layer and transporting the holes through the charge transport layer include triphenylmethane, bis(4-diethylamine-2-methylphenyl) phenylmethane; 4'-4''-bis(diethylamino)-2',2''-dimethyltriphenyl methane and the like dispersed in an inactive resin binder.

Numerous inactive resin materials may be employed in the charge transport layer including those described, for example, in U.S. Pat. No. 3,121,006, the entire disclosure of which is incorporated herein by reference. The resinous binder for the charge transport layer may be identical to the resinous binder material employed in the charge generating layer. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-alkyd resins, and the like. These polymers may be block, random or alternating copolymers. Excellent results may be achieved with a resinous binder material comprising a poly(hydroxyether) material selected from the group consisting of those of the following formulas:

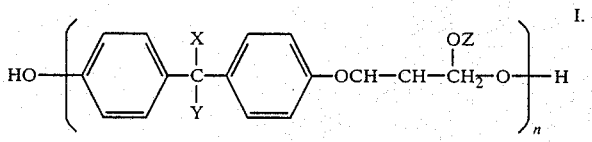

and

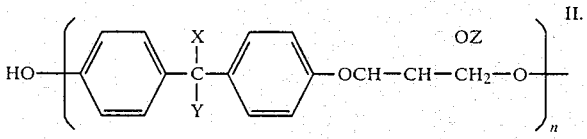

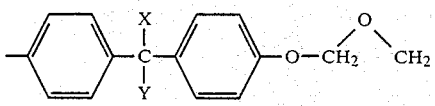

wherein X and Y are independently selected from the group consisting of aliphatic groups and aromatic groups, Z is hydrogen, an aliphatic group or an aromatic group, and n is a number of from about 50 to about 200.

These poly(hydroxyethers), some of which are commercially available from Union Carbide Corporation, are generally described in the literature as phenoxy resins or epoxy resins.

Examples of aliphatic groups for the poly(hydroxyethers), include those containing from about 1 carbon atom to about 30 carbon atoms, such as methyl, ethyl, propyl, butyl, pentyl, hexyl, heptyl, decyl, pentadecyl, eicodecyl, and the like. Preferred aliphatic groups include alkyl groups containing from about 1 carbon atom to about 6 carbon atoms, such as methy, ethyl, propyl, and butyl. Illustrative examples of aromatic groups include those containing from about 6 carbon atoms to about 25 carbon atoms, such a phenyl, naphthyl, anthryl, and the like, with phenyl being preferred. The aliphatic and aromatic groups can be substituted with various known substituents, including for example, alkyl, halogen, nitro, sulfo and the like.

Examples of the Z substituent include hydrogen as well as aliphatic aromatic, substituted aliphatic and substituted aromatic groups as defined herein. Furthermore Z can be selected from carboxyl, carbonyl, carbonate, and other similar groups, resulting in for example, the corresponding esters, and carbonates of the poly(hydroxyethers).

Preferred poly(hydroxyethers) include those wherein X and Y are alkyl groups, such as methyl, Z is hydrogen or a carbonate group, and n is a number ranging from about 75 to about 100. Specific preferred poly(hydroxyethers) include Bakelite, phenoxy resins PKHH, commercially available from Union Carbide Corporation and resulting from the reaction of 2,2-bis(4-hydroxyphenylpropane), or bisphenol A, with epichlorohydrin, an epoxy resin, AralditeR 6097, commercially available from CIBA, the phenylcarbonate of the poly(hydroxyethers) wherein Z is a carbonate grouping, which material is commercially available from Allied Chemical Corporation, as well as poly(hydroxyethers) derived from dichloro bis phenol A, tetrachloro bis phenol A, tetrabromo bis phenol A, bis phenol F, bis phenol ACP, bis phenol L, bis phenol V, bis phenol S, and the like and the like.

The photogenerating layer containing photoconductive compositions and/or pigments and the resinous binder material generally ranges in thickness of from about 0.1 micron to about 5.0 microns, and preferably has a thickness of from about 0.3 micron to about 1 micron. Thicknesses outside these ranges can be selected providing the objectives of the present invention are achieved.

The photogenerating composition or pigment is present in the poly(hydroxyethers) resinous binder composition in various amounts, generally, however, from about 10 percent by volume to about 60 percent by volume of the photogenerating pigment is dispersed in about 40 percent by volume to about 90 percent by volume of the poly(hydroxyether) binder, and preferably from about 20 percent by volume to about 30 percent by volume of the photogenerating pigment is dispersed in about 70 percent by volume to about 80 percent by volume of the poly(hydroxyether) binder composition. In one embodiment about 25 percent by volume of the photogenerating pigment is dispersed in about 75 percent by volume of the poly(hydroxyether) binder composition.

Other typical photoconductive layers include amorphous or alloys of selenium such as selenium-arsenic, selenium-tellurium-arsenic, selenium-tellurium, selenium-arsenic-antimony, halogen doped selenium alloys, cadmium sulfide and the like.

Generally, the thickness of the transport layer is between about 5 to about 100 microns, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Referring now to the drawings, FIG. 1 illustrates a typical overcoating photoreceptor 10 of the prior art utilizing an electrically insulating overcoating 12 on a photoconductive layer 14 supported by a conductive substrate 16. Upon uniform charging in the dark such as with positive corona charging, the resulting charged overcoated photoreceptor 10 has a uniformly deposited charge on the outside surface 18 of insulating overcoating 12. A corresponding opposite negative charge is formed in the conductive substrate 16 adjacent the interface with the photoconductive layer 14.

Figure 2:
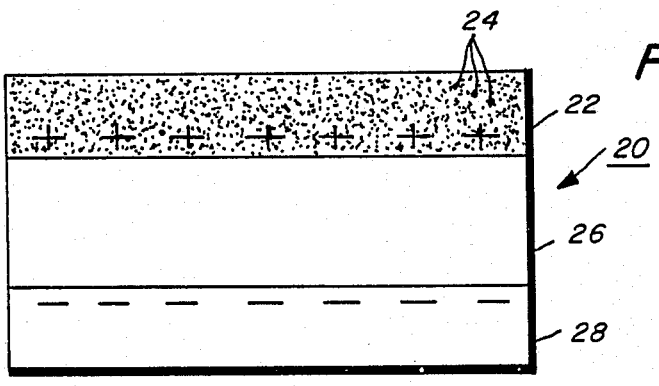
FIG. 2 graphically illustrates the location of charges when utilizing a photoreceptor overcoated with a conductive layer containing particles in a binder.

In FIG. 2, a typical prior art overcoated photoreceptor 20 is shown in which a conductive overcoating 22 containing dispersed conductive particles 24 overlies a photoconductive layer 26 supported by conductive substrate 28. This electrophotographic imaging member is uniformly charged in the dark such as by positive corona charging. The resulting charged overcoated photoreceptor 20 has a positive charge in the overcoating layer 22 adjacent the interface with the photoconductive layer 26. A corresponding opposite negative charge is formed in conductive substrate 28 adjacent to the interface with the photoconductive layer 26. The conductive particles 24 in conductive overcoating layer 22 renders the overcoating layer sufficiently conductive to cause the formation of the uniform charge in the conductive layer 22 adjacent the interface with the electrophotoconductive layer 26. Although the conductive layer 22 illustrated in FIG. 2 is depicted as containing conductive particles 24 dispersed in the conductive overcoating 22, the conductive overcoating 22 may also be formed, as is well known in the prior art, with a soluble conductive material such as quaternary ammonium salts and charge transfer compounds formed from the interaction of electron donors and electron acceptors. In either case, the charge after uniform charging in the dark forms in the overcoating adjacent the interface with the photoconductive layer.

Figure 3:
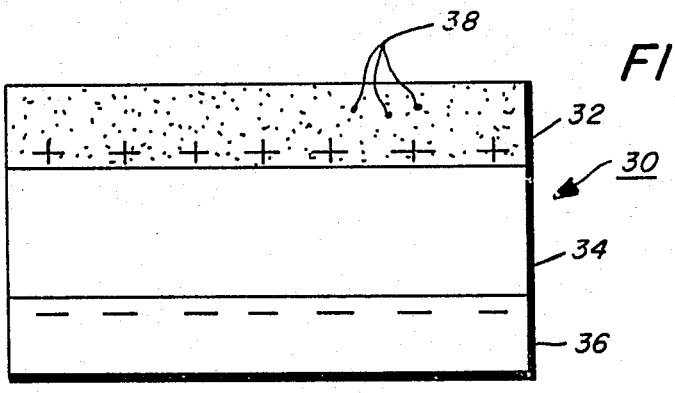
FIG. 3 graphically illustrates the location of charges when utilizing a photoreceptor overcoated with an overcoating embodiment of this invention.
Figure 4:
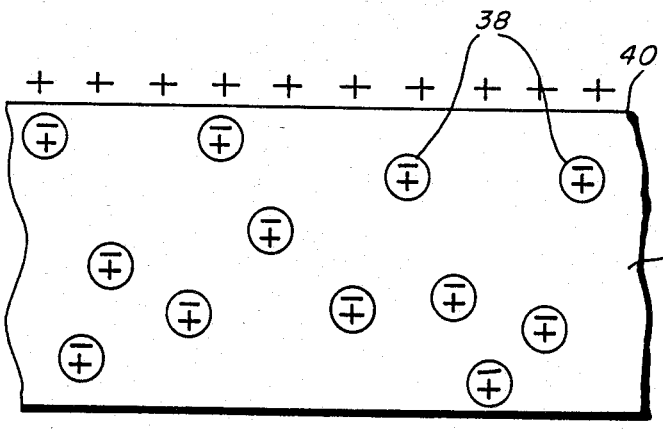
FIG. 4 grahically illustrates the polarization of charge injection enabling particles in an overcoating embodiment of this invention.

In FIGS. 3 and 4, the preferred embodiment of a novel overcoated photoreceptor is shown wherein an electrophotographic imaging member 30 comprises an overcoating layer 32 on a photoconductive layer 34 supported by a conductive substrate 36. The overcoating layer 32 comprises a continuous charge transport phase 37 and charge injection enabling particles 38. When the electrophotographic imaging member 30 is uniformly charged in the dark such as by positive corona charging, the resulting charged electrophotographic imaging member 30 bears a uniform positive charge in the overcoating layer adjacent to the interface with the photoconductive layer 34 and an opposite and equal negative charge in the conductive substrate 36 adjacent to the interface with photoconductive layer 34.

Figure 5:
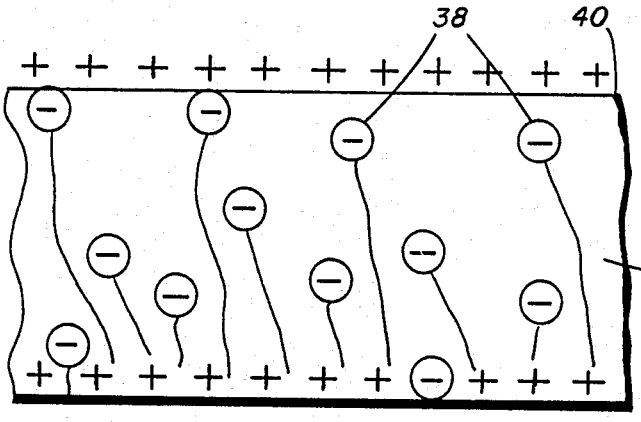
FIG. 5 graphically illustrates charges injected into a continuous phase transport medium and driven by an electric field to a photoreceptor-overcoat interface.
Figure 6:
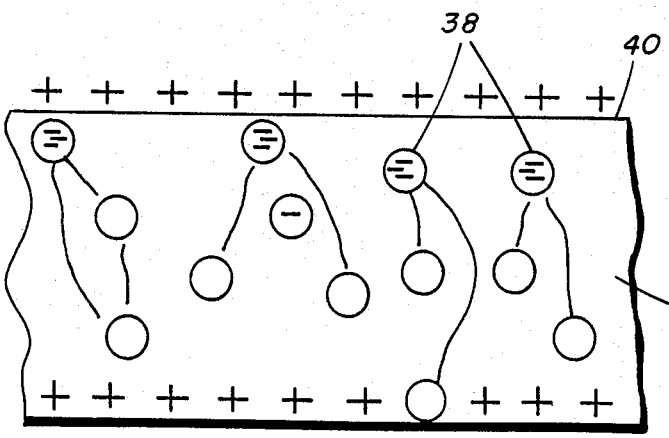
FIG. 6 graphically illustrates relaxation of space charge in the bulk of an overcoating by emission from charge injection enabling particles.

An expanded view of overcoating layer 32 contained charge injection enabling particles 38 is illustrated in FIG. 4. It is believed that when the electrophotographic imaging member of this invention is charged, such as by positive corona charging, the electric field formed between the outer surface 40 overcoating layer 32 and the conductive substrate 36 instantly polarizes the charge injection enabling particles. This polarization is depicted by the − and + symbols in each of the charge injection enabling particles 38 shown in FIG. 4. Charge illustrated here as + charges for positive charging, are injected into the continuous phase 37 of the overcoating layer 32 containing charge transport molecules and are driven by the charging field to the interface between the overcoating layer 32 and photoconductive layer 34 as shown in FIG. 5. The charges are stopped at the interface because there is no injection into the photoconductor due to charge trapping by the photoreceptor or by a blocking layer (not shown) both of which are referred to herein as the interface between the photoconductive layer and the overcoating layer. The negative space charge in the bulk of the overcoating layer is relaxed by charge emission, hole emission in this case for positive charging, from the charge injection enabling particles 38 closer to the outer imaging surface 40 of the overcoating layer 32 until only those particles near the outer imaging surface 40 of the overcoating layer 32 remain charged as shown in FIG. 6. A final charged electrophotographic imaging member 30 prior to illumination in image configuration is illustrated in FIG. 3. The development field during development following exposure to activating illumination in image configuration is no sufficiently strong to cause charge redistribution in overcoating layer 32.

Although uniform positive charging is shown in the drawings, uniform negative charging may be used instead of positive charging. Obviously, these figures merely schematically illustrate the invention and are not intended to indicate relative size and dimensions of actual imaging members or components thereof.

Thus, the novel imaging structure of this invention provides excellent protection of photoconductive imaging members while allowing a wide choice of film forming binders, charge transport molecules and charge injection enabling particles. Because of the wide selection of film forming binders available, overcoat binders may be chosen for their triboelectric interaction with the toner, their cleanability and the like, without greatly affecting the electrical performance of the overcoat. Moreover, a relatively low concentration of charge injection enabling particles enhances overcoating layer integrity and allows a greater latitude in overcoating layer thickness with less impact on overcoating transparency.

The invention will now be described in detail with respect to specific preferred embodiments thereof along with control examples, it being noted that these examples are intended to be illustrative only and are not intended to limit the scope of the present invention. Parts and percentages are by weight unless otherwise indicated. The electrical resistivities of the carbon black pigments employed in the examples were about $10^{-1}$ ohm-cm to about $10^{2}$ ohm-cm as indicated in data sheets supplied by the manufacturers. Normally, resistivity of a powder is measured in the bulk dry state by compressing the powder in a glass tube between electrodes and measuring the electrical resistance of the compressed mass.

EXAMPLES 1-4

Various coating composition batches were prepared by mixing in a paint shaker, Red Devil Model No. 5100X, available from Red Devil Inc., Union, N.J., with 3.2 millimeter diameter stainless steel shot for about 90 minutes, a polycarbonate resin (Makrolon 5705) available from Mobay Chemical Corporation, and about 94 weight percent of methylene chloride, based on the weight of the polycarbonate resin, about 40 percent by weight based on the total weight of the polycarbonate resin of N,N'-diphenyl-N,N'-bis(3-methylphenyl) 1,1'-biphenyl-4,4'-diamine and various concentrations of carbon black (Monarch 1300) available from Cabot Corporation. The amount of carbon black added was based on total combined weight of the polycarbonate resin and N,N'-diphenyl-N,N'-bis(3-methylphenyl) 1,1'-biphenyl-4,4'-diamine. The carbon black had a surface ($N_2$S.A.) of about 560 square meters per gram, a particle size of about 13 millimicrons, a fixed carbon of about 90.5 percent and medium electrical resistivity relative to other carbon blacks supplied by Cabot Corporation. The coating composition was applied to brush grained aluminum sheets by means of a Gardner Draw Bar Coater (available from Pacific Scientific) equipped with a coating bar with a 0.002 inch gap for depositing a wet film thickness which upon drying yields the coating thickness listed in the table, and dried in a forced air oven at about 100° C. for about 1 hour to form coatings containing the diamine dissolved in the polycarbonate resin binder with various concentrations of carbon black pigment (if present) uniformly dispersed throughout the deposited coating. The results of physical and electrical tests on th coated aluminum sheets are set forth below:

| EXAMPLES | WEIGHT PERCENT CARBON BLACK | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|
| 1 | 0 | 7 | +7 | >1000 | — | >1000 |
| | | | −7 | >−1000 | — | >−1000 |
| 2 | 0.01 | 5 | +7 | +660 | 20 | +640 |
| | | | −7 | −340 | −40 | −300 |
| 3 | 0.1 | 5 | +7 | +320 | +15 | +300 |
| | | | −7 | −120 | −20 | −95 |
| 4 | 1.0 | 5 | +7 | +55 | +5 | +50 |
| | | | −7 | −5 | 0 | −2 |

The percent transmission of light having a wavelength between about 4,000 Angstroms and about 7,000 Angstroms for the coatings of Examples 3 and 4 was determined by the use of a densitometer made by Brumac Industries. The instrument was first calibrated using a photographic step table and the percent transmission thereafter measured. The percent transmission of the coating in Example 3 was 99 percent and the percent transmission of the coating in Example 4 was about 88 percent. The charge level, dark decay and residual voltage were determined by a laboratory electrostatic scanning device consisting of a Monroe Model 152A corotron power supply, Keithley 610C Electrometer and Hewlett Packard 7402A Recorder. The overcoated sample was mechanically moved under the corotron to deposite charge and then under an electrometer probe to measure the charge on the surface, decay rate, and residual voltage.

These examples clearly demonstrate that residual voltage after about >1.0 second varies dramatically with varying amounts of the carbon black charge injection enabling particles. Good results were achieved with about 0.1 weight percent carbon black and excellent results were achieved with as little as 1 weight percent carbon black.

EXAMPLES 5-7

The materials and procedures described in the preceeding examples were repeated to form coatings on brushed aluminum sheets for various concentrations of carbon black, but without any N,N'-diphenyl-N,N'-bis(3-methylphenyl) 1,1'-biphenyl-4,4'-diamine. Electrical measurements were made on these coated sheets with the procedures and equipment described above with reference to Examples 1-4. The results of these tests are set forth below:

| EXAMPLES | WEIGHT PERCENT CARBON BLACK | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|
| 5 | 0.01 | 5.3 | +7 | >1000 | — | >1000 |
| | | | −7 | >−1000 | — | >−1000 |
| 6 | 0.1 | 5.0 | +7 | +670 | 5 | +650 |
| | | | −7 | −720 | 5 | −700 |
| 7 | 1.0 | 5.5 | +7 | +515 | 0 | +495 |
| | | | −7 | −600 | 10 | +575 |

Although some reduction of charge level and residual voltage was observed for increasing concentrations of carbon black, the absence of the charge transport material N,N'-diphenyl-N,N'-bis(3-methylphenyl) 1,1'-biphenyl-4,4'-diamine clearly results in unacceptably high residual voltage and illustrates that the overcoating is substantially insulating at these concentrations of carbon black in the absence of the charge transport material.

EXAMPLES 8-14

The procedures described with respect to Examples 1-7 are repeated except that carbon black (Katjen black EC, available from ARMAK Company, Chicago, Ill.), was substituted for the carbon black (Monarch 1300). The concentrations of the diamine charge transport material and the carbon black were varied as indicated in the table below:

| EXAMPLES | WEIGHT PERCENT DIAMINE | WEIGHT PERCENT CARBON BLACK | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 8 | 0 | 1.0 | 4 | +7 | +390 | 10 | 380 |
| | | | | −7 | −320 | 2 | −315 |
| 9 | 0 | 0.1 | 3.5 | +7 | +680 | 2 | +663 |
| | | | | −7 | −680 | 5 | −670 |
| 10 | 0 | 0.01 | 3.3 | +7 | >1000 | 0 | >+1000 |
| | | | | −7 | <−1000 | 0 | <−1000 |
| 11 | 40 | 1.0 | 4.0 | +7 | +59 | 1 | +58 |
| | | | | −7 | −18 | 0 | −18 |
| 12 | 40 | 0.1 | 4.0 | +7 | +220 | 2 | +218 |
| | | | | −7 | −40 | 0 | −40 |
| 13 | 40 | 0.01 | 3.3 | +7 | +425 | 25 | +405 |
| | | | | −7 | −80 | 10 | −70 |
| 14 | 40 | 0 | 7.0 | +7 | >1000 | 0 | >1000 |
| | | | | −7 | ~−980 | 0 | ~980 |

The resulting residual voltage was dramatically reduced when the coating contained the combination of the charge transport molecules and finely divided charge injection enabling particles, particularly at the concentration levels employed in Examples 11 and 12.

EXAMPLES 15-22

The procedures described in Examples 8-14 were repeated except that $SnO_2/Sb_2O_3$ pigment having an 85/15 weight ratio of Sn/Sb (available from Mitsubishi Metals Limited, Japan) was substituted for the carbon black and bis-(4-diethylamino-2-methylphenyl)-phenylmethane was substituted for the N,N'-diphenyl-N,N'-bis(3-methylphenyl) 1,1'-biphenyl-4,4'-diamine. Also, instead of the paint shaker utilized in the preceding examples, the components of the coating compositions were dispersed by milling for 48 hours in a roll mill. The materials (binder, charge injection enabling particles and charge transport molecule) were placed in a 4 ounce glass jar, half filled with 9 millimeter glass beads and placed on a Norton Chemical Process Products Division roll mill. The deposited coating was dried in a forced air oven for 2 hours at 100° C. Prior to deposition of the coating composition, a blocking layer was applied to the brushed aluminum sheet in Examples 15, 17, 19 and 21. The blocking layer was a composition containing about 2 weight percent based on the total weight of an ethanol mixture of a 1:1 by weight mixture of a polyethyleneimine (PEI) polymer (Carcat P-600 available from Carbona Chemical Company, Mich.) and zirconium acetylacetonate (ZrAc).

| EXAMPLES | WEIGHT PERCENT $S_nO_2$/ $Sb_2O_3$ | WEIGHT PERCENT PHENYL METHANE | BLOCKING LAYER TYPE PEI/ZrAc | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|---|
| 15 | 0 | 50 | PEI/ | 5.7 | +7 | +605 | 0 | +545 |
| | | | ZrAc | | −7 | −825 | 10 | −780 |
| 16 | 0 | 50 | None | 5.0 | +7 | +525 | 0 | +475 |
| | | | | | −7 | −45 | 0 | −45 |
| 17 | 10 | 40 | PEI/ | 6.5 | +7 | +75 | 0 | +75 |
| | | | ZrAc | | −7 | −45 | 0 | −45 |
| 18 | 10 | 40 | None | 6.5 | +7 | +70 | 0 | +65 |
| | | | | | −7 | −60 | 0 | −60 |
| 19 | 10 | 50 | PEI/ | 6.3 | +7 | +65 | 2 | +65 |
| | | | ZrAc | | −7 | −42 | 0 | −42 |
| 20 | 10 | 50 | None | 6.0 | +7 | +65 | 0 | +65 |
| | | | | | −7 | −60 | 2 | −58 |
| 21 | 10 | 60 | PEI/ | 7.0 | +7 | +62 | 2 | +60 |
| | | | ZrAc | | −7 | −50 | 0 | −50 |
| 22 | 10 | 60 | None | 7.0 | +7 | +60 | 1 | +60 |
| | | | | | −7 | −60 | 2 | −58 |

As evident from the residual voltages observed, excellent results were obtained with the combination of the finely divided charge injection enabling particles and charge transport molecule dissolved in the polycarbonate resin with a slight improvement in some test samples when a blocking layer was utilized.

EXAMPLES 23–30

The procedures and materials of Examples 15–22 were repeated except that 2,5,bis(4-diethylamino-phenyl)-1,3,4-oxadiazole was substituted for bis-(4-diethtylamino-2-methylphenyl)-phenyl-methane. Various amounts of charge injection enabling particles, charge transport molecules and blocking layer were utilized as set forth below:

The residual voltage observed was markedly reduced when the combination of the charge injection enabling particles and the charge transport molecule were both utilized in the coating. In some cases, a slight improvement was observed when a blocking layer was employed.

EXAMPLES 31–38

The procedures and materials of Examples 23–30 were repeated except that p-diethylamino benzaldehyde-(diphenylhydrazone) was substituted for 2,5-bis-(4-diethylaminophenyl)-1,3,4 oxadiazole. Various amounts of charge injection enabling particles, charge transport molecules and blocking layer were utilized as set forth below:

| EXAMPLES | WEIGHT PERCENT $S_nO_2$/ $Sb_2O_3$ | WEIGHT PERCENT OXADIA-ZOLE | BLOCKING LAYER TYPE PEI/ZrAc | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|---|
| 23 | 0 | 50 | PEI/ | 6.3 | +7 | +840 | 15 | +780 |
| | | | ZrAc | | −7 | −945 | 15 | −920 |
| 24 | 0 | 50 | None | 6.7 | +7 | +760 | 10 | +705 |
| | | | | | −7 | −860 | 15 | −810 |
| 25 | 10 | 40 | PEI/ | 6.5 | +7 | +60 | 0 | +60 |
| | | | ZrAc | | −7 | −50 | 5 | −45 |
| 26 | 10 | 40 | None | 6.7 | +7 | +70 | 0 | +70 |
| | | | | | −7 | −55 | 0 | −55 |
| 27 | 10 | 50 | PEI/ | 6.7 | +7 | +60 | 0 | +55 |
| | | | ZrAc | | −7 | −45 | 0 | −45 |
| 28 | 10 | 50 | None | 6.0 | +7 | +60 | 0 | +55 |
| | | | | | −7 | −45 | 0 | −40 |
| 29 | 10 | 60 | PEI/ | 6.0 | +7 | +50 | 0 | +50 |
| | | | ZrAc | | −7 | −40 | 0 | −40 |
| 30 | 10 | 60 | None | 5.7 | +7 | +60 | 2 | +58 |
| | | | | | −7 | −42 | 0 | −40 |

| EXAMPLES | WEIGHT PERCENT $S_nO_2$/ $Sb_2O_3$ | WEIGHT PERCENT HYDRA-ZONE | BLOCKING LAYER TYPE PEI/ZrAc | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|---|
| 31 | 0 | 50 | PEI/ | 5.0 | +7 | +680 | 15 | +640 |
| | | | ZrAc | | −7 | −960 | −20 | −935 |
| 32 | 0 | 50 | None | 5.5 | +7 | +640 | 20 | +640 |
| | | | | | −7 | −920 | −40 | −880 |
| 33 | 10 | 40 | PEI/ | 8.5 | +7 | +55 | 5 | +50 |
| | | | ZrAc | | −7 | −30 | | −25 |
| 34 | 10 | 40 | None | 6.5 | +7 | +45 | 5 | +40 |
| | | | | | −7 | −20 | 0 | −20 |
| 35 | 10 | 50 | PEI/ | 6.0 | +7 | +10 | 5 | +5 |
| | | | ZrAc | | −7 | −35 | −5 | −30 |

-continued

| EXAMPLES | WEIGHT PERCENT $S_nO_2$/ $Sb_2O_3$ | WEIGHT PERCENT HYDRA-ZONE | BLOCKING LAYER TYPE PEI/ZrAc | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|---|
| 36 | 10 | 50 | None | 6.0 | +7 | +25 | 7 | +18 |
| | | | | | −7 | 0 | 0 | −20 |
| 37 | 10 | 60 | PEI/ | 6.7 | +7 | +12 | 0 | +12 |
| | | | ZrAc | | −7 | −40 | 0 | −40 |
| 38 | 10 | 60 | None | 8.0 | +7 | +5 | 2 | +3 |
| | | | | | −7 | −20 | 0 | −20 |

The residual voltage observed was markedly reduced when the combination of the charge injection enabling particles and the charge transport molecule were both utilized in the coating. In some cases, mixed results in plates with a blocking layer and plates without a blocking layer were observed.

EXAMPLES 39–40

The procedures and materials described with respect to Examples 8–14 were repeated except that 9-ethylcarbazole-3-carboaldehyde-1-methyl-1-phenylhydrazone was substituted for N,N'-diphenyl-N,N'-bis(3-methylphenyl) 1,1'-biphenyl-4,4'-diamine. Also, drying was effected by overnight drying at room temperature under ambient conditions. No charge transport molecule was used in Example 39.

| EXAMPLES | WEIGHT PERCENT HYDRA-ZONE | WEIGHT PERCENT CARBON BLACK | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 39 | 0 | 1.0 | 5.5 | +7 | +515 | 0 | +495 |
| | | | | −7 | −600 | 10 | −575 |
| 40 | 40 | 1.0 | 6.7 | +7 | +100 | 0 | +100 |
| | | | | −7 | −10 | 0 | −10 |

The residual voltage observed was markedly reduced with the combination of the charge injection enabling particles and the charge transport molecule.

EXAMPLES 41–44

The procedures and materials described with respect to Examples 8–14 were repeated except that the overcoating layer was dried in a vacuum oven at a pressure of about 30 inches of Mercury at 75° C. for about 17 hours instead of in a forced air oven. Various amounts of the charge transport molecules and charge injection enabling particles were utilized as set forth in the examples below:

| EXAMPLES | WEIGHT PERCENT DIAMINE | WEIGHT PERCENT CARBON BLACK | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 41 | 40 | 1 | 19 | +7 | +77 | 2 | +77 |
| | | | | −7 | −18 | 0 | −18 |
| 42 | 40 | 0 | 18 | +7 | +1000 | 0 | +1000 |
| | | | | −7 | −1000 | 0 | −1000 |
| 43 | 0 | 1 | 23 | +7 | +1000 | 0 | +1000 |
| | | | | −7 | −990 | 0 | −990 |
| 44 | 0 | 0 | 21 | +7 | +1000 | 0 | +1000 |
| | | | | −7 | −1000 | 0 | −1000 |

A marked reduction in residual voltage was observed for the overcoating layer containing the combination of the finely divided charge injection enabling particles and the charge transport molecule.

EXAMPLES 45–50

The procedures and materials described with respect to Examples 41–44 were repeated except that carbon black (Raven 5000, available from Columbian Chemical Company) was substituted for the carbon black (Monarch 1300) and drying was effected at room temperature under ambient conditions over a weekend. The carbon black had a surface ($N_2$S.A.) of about 83 square meters per gram, a particle size of about 24 millimicrons, a fixed carbon of about 95 percent and high electrical resistivity relative to other carbon blacks supplied by Cabot Corporation. Coatings with and without the charge transport molecule are compared below:

| EXAMPLES | WEIGHT PERCENT DIAMINE | WEIGHT PERCENT CARBON BLACK | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 45 | 40 | 0.1 | 5.0 | +7 | +470 | 25 | +440 |
| | | | | −7 | −30 | 0 | −30 |
| 46 | 40 | 0.5 | 5.7 | +7 | +165 | 5 | +160 |
| | | | | −7 | −15 | 5 | −10 |
| 47 | 40 | 1.0 | 5.2 | +7 | +100 | 3 | +97 |

-continued

| EXAMPLES | WEIGHT PERCENT DIAMINE | WEIGHT PERCENT CARBON BLACK | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| | | | | −7 | −5 | 0 | −5 |
| 48 | 0 | 0.1 | 6.0 | +7 | +830 | 5 | +805 |
| | | | | −7 | −825 | 5 | −820 |
| 49 | 0 | 0.5 | 4.2 | +7 | +735 | 0 | +738 |
| | | | | −7 | −740 | 5 | −735 |
| 50 | 0 | 1.0 | 5.2 | +7 | +680 | 0 | +640 |
| | | | | −7 | −700 | 10 | −685 |

Significant reduction of residual voltage was observed for the combination of the charge transport molecule and charge injection enabling particles, particularly at the charge injection enabling particle concentrations employed in Examples 46 and 47. Relatively low residual voltage was also observed for negative charging in Example 45. Light transmission of the coating described in Example 47 was about 78 percent as determined by the procedure described in Examples 3 and 4.

EXAMPLES 51-56

The procedures and materials of Examples 39 and 40 were repeated except that graphite particles (Micrographite No. 785, available from Asbury Graphite Mills Inc.) was substituted for the carbon black (Monarch 1300). Although product literature indicated a fineness of 0.80 to 0.90 micrometers A. P. D. (as determined by a Fisher Sub-Sieve Sizer), the dispersions obtained with the graphite were not uniform due to the large particle size agglomerates of the graphite. The median particle size ranged from about 2 micrometers up to about 5 micrometers. Overcoating compositions with and without the charge transport molecule and with varying amounts of graphite are compared in the examples below:

| EXAMPLES | WEIGHT PERCENT DIAMINE | WEIGHT PERCENT GRAPHITE | TOTAL THICKNESS (μM) | COROTRON VOLTS (KV) | CHARGE LEVEL (V) | DARK DECAY (V/SEC) | RESIDUAL VOLTS (V) | PERCENT TRANS VISUAL FILTER |
|---|---|---|---|---|---|---|---|---|
| 51 | 40 | 1.0 | 5.3 | +7 | +250 | 20 | +220 | 91 |
| | | | | −7 | −40 | 5 | −25 | |
| 52 | 40 | 2.0 | 8.0 | +7 | +215 | 15 | +200 | 83 |
| | | | | −7 | −30 | 5 | −20 | |
| 53 | 40 | 3.0 | 6.3 | +7 | +150 | 10 | +140 | 74 |
| | | | | −7 | −25 | 5 | −20 | |
| 54 | 0.0 | 1.0 | 7.7 | +7 | +540 | 0 | +545 | 93 |
| | | | | −7 | −765 | 3 | −760 | |
| 55 | 0.0 | 2.0 | 5.7 | +7 | +520 | 0 | +505 | 85 |
| | | | | −7 | −720 | 5 | −690 | |
| 56 | 0.0 | 3.0 | 6.3 | +7 | +525 | 0 | +520 | 78 |
| | | | | −7 | −675 | 10 | −640 | |

The percent transmission was determined by using the equipment and method described in Examples 1-4. A large reduction in the residual voltage was observed when the combination of the charge injection enabling particles and the charge transport molecule were utilized. Best results were obtained with negative charging.

EXAMPLES 57-62

The procedures and materials described with respect to Examples 51-56 were repeated except that fluorinated graphite particles (Fluorographite RT-1-18, having a resistivity of about 1.6 ohm-cm, available from Pennwalt Corporation) was substituted for the graphite (Micrographite No. 785). Coating compositions with and without the charge transport molecules and with varying amounts of charge injection enabling particles are compared below:

| EXAMPLES | WEIGHT PERCENT DIAMINE | WEIGHT PERCENT FLUORI-NATED GRAPHITE | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 57 | 0 | 1.0 | 4.5 | +7 | +660 | 0 | +640 |
| | | | | −7 | −782 | 2 | −760 |
| 58 | 0 | 2.0 | 6.7 | +7 | +715 | 0 | +700 |
| | | | | −7 | −820 | 5 | −810 |
| 59 | 0 | 3.0 | 7.3 | +7 | +640 | 0 | +640 |
| | | | | −7 | −770 | 10 | −760 |
| 60 | 40 | 1.0 | 5.2 | +7 | +195 | 15 | +180 |
| | | | | −7 | −5 | 0 | −5 |
| 61 | 40 | 2.0 | 7.3 | +7 | +170 | 10 | +160 |
| | | | | −7 | −10 | 0 | −10 |
| 62 | 40 | 3.0 | 7.7 | +7 | +120 | 2 | +115 |
| | | | | −7 | −5 | 0 | −5 |

Significant reduction of residual voltage was observed for the combination of the charge transport molecule and charge injection enabling particles. Best results were obtained with negative corona charging.

EXAMPLES 63–68

The procedures and materials of Examples 45–50 were repeated except that a fluorinated graphite (Fluorographite RJ-3-131, available from Pennwalt Corporation and having a resistivity of 246 ohm-cm) was substituted for the carbon black (Raven 5000). Coating compositions with and without the charge transport molecules and with varying amounts of graphite are compared below:

| EXAMPLES | WEIGHT PERCENT DIAMINE | WEIGHT PERCENT FLUORI-NATED GRAPHITE | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 63 | None | 1.0 | 6.7 | +7 | +620 | 0 | +620 |
| | | | | −7 | −790 | 10 | −780 |
| 64 | None | 2.0 | 8.0 | +7 | +660 | 0 | +660 |
| | | | | −7 | −802 | 0 | −800 |
| 65 | None | 3.0 | 5.2 | +7 | +560 | 5 | +555 |
| | | | | −7 | −690 | 10 | −670 |
| 66 | 40 | 1.0 | 5.5 | +7 | +240 | 10 | +210 |
| | | | | −7 | −10 | 5 | −5 |
| 67 | 40 | 2.0 | 5.3 | +7 | +155 | 15 | +140 |
| | | | | −7 | −5 | 0 | −5 |
| 68 | 40 | 3.0 | 8.3 | +7 | +120 | 10 | +105 |
| | | | | −7 | 0 | 0 | −0 |

A large reduction of residual voltage was observed for the coatings containing the combination of the charge transport molecule and charge injection enabling particles. Best results were obtained with negative corona charging.

EXAMPLES 69–74

The procedures and materials of Examples 63–68 were repeated except that a fluorinated graphite (Fluorographite RT-4-14A, available from Pennwalt Corporation and having a resistivity of $9\times10^4$ ohm-cm) was substituted for the fluorinated graphite (Fluorographite RJ-3-131). Overcoatings with and without the charge transport molecules and with varying amounts of graphite are compared below:

| EXAMPLES | WEIGHT PERCENT DIAMINE | WEIGHT PERCENT FLUORI-NATED GRAPHITE | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 69 | None | 1.0 | 6.2 | +7 | +760 | 2 | +758 |
| | | | | −7 | −830 | 5 | −820 |
| 70 | None | 2.0 | 6.0 | +7 | +770 | 5 | +745 |
| | | | | −7 | −855 | 10 | −845 |
| 71 | None | 3.0 | 6.3 | +7 | +890 | 5 | +850 |
| | | | | −7 | −890 | 5 | −880 |
| 72 | 40 | 1.0 | 6.0 | +7 | +280 | 20 | +260 |
| | | | | −7 | −15 | 0 | −15 |
| 73 | 40 | 2.0 | 4.7 | +7 | +160 | 5 | +150 |
| | | | | −7 | −5 | 0 | −5 |
| 74 | 40 | 3.0 | 6.0 | +7 | +120 | 10 | +105 |
| | | | | −7 | −10 | 0 | −5 |

A large reduction of residual voltage was observed for the coatings containing the combination of the charge transport molecule and charge injection enabling particles. Best results were observed with negative charging.

EXAMPLES 75–80

The procedures and materials of Examples 63–68 were repeated except that chromium dioxide particles (available from duPont Inc.) was substituted for the fluoronated graphite (Fluorographite RJ-3-131). Overcoating compositions with and without the charge transport molecule and with varying amounts of the charge injection enabling particles are compared in the examples below:

| EXAMPLES | WEIGHT PERCENT DIAMINE | WEIGHT PERCENT $CrO_2$ | TOTAL THICKNESS (μM) | COROTRON VOLTS (KV) | CHARGE LEVEL (V) | DARK DECAY (V/SEC) | RESIDUAL VOLTS (V) | PERCENT TRANS-MISSION |
|---|---|---|---|---|---|---|---|---|
| 75 | 0 | 1.0 | 5.7 | +7 | +570 | 5 | +505 | 85 |
| | | | | −7 | −840 | 20 | −800 | |
| 76 | 0 | 2.0 | 6.3 | +7 | +560 | 0 | +550 | 71 |
| | | | | −7 | −745 | 20 | −680 | |
| 77 | 0 | 3.0 | 7.0 | +7 | +500 | 0 | +480 | 63 |
| | | | | −7 | −630 | 10 | −600 | |
| 78 | 40 | 1.0 | 5.7 | +7 | +180 | 10 | +160 | 85 |
| | | | | −7 | −22 | 2 | −20 | |

-continued

| EXAMPLES | WEIGHT PERCENT DIAMINE | WEIGHT PERCENT $CrO_2$ | TOTAL THICKNESS (μM) | COROTRON VOLTS (KV) | CHARGE LEVEL (V) | DARK DECAY (V/SEC) | RESIDUAL VOLTS (V) | PERCENT TRANS-MISSION |
|---|---|---|---|---|---|---|---|---|
| 79 | 40 | 2.0 | 9.0 | +7 | +105 | 5 | +100 | 72 |
| | | | | −7 | −5 | 0 | −5 | |
| 80 | 40 | 3.0 | 6.0 | +7 | +65 | 5 | +60 | 63 |
| | | | | −7 | −5 | 0 | −5 | |

Significant reduction in the residual voltage was obtained with the combination of the charge injection enabling particles and the charge transport molecule. Best results were obtained with negative corona charging. The percent transmission was determined after the overcoating was applied to a polyester film (Mylar, available from E. I. duPont Co.) by means of the equipment and method described in Examples 1–4.

EXAMPLES 81–86

The procedures and materials of Examples 75–80 were repeated except that $Fe_3O_4$ particles (William's Magnetic Oxide MO-4232, available from Chas. Pfizer & Co. Inc., Minerals, Pigments and Metals Division) were substituted for the $CrO_2$ particles. Overcoating compositions with and without the charge transport molecule and with varying amounts of the charge injection enabling particles are compared in the examples below:

| EXAMPLES | WEIGHT PERCENT DIAMINE | $Fe_3O_4$ WEIGHT PERCENT | TOTAL THICKNESS (μM) | COROTRON VOLTS (KV) | CHARGE LEVEL (V) | DARK DECAY (V/SEC) | RESIDUAL VOLTS (V) | PERCENT TRANS-MISSION |
|---|---|---|---|---|---|---|---|---|
| 81 | 0 | 1.0 | 5.8 | +7 | +670 | 0 | +670 | 91 |
| | | | | −7 | −800 | 0 | −800 | |
| 82 | 0 | 2.0 | 6.2 | +7 | +575 | 0 | +560 | 83 |
| | | | | −7 | −720 | 0 | −715 | |
| 83 | 0 | 3.0 | 7.0 | +7 | +680 | 0 | +660 | 72 |
| | | | | −7 | −860 | 10 | −850 | |
| 84 | 40 | 1.0 | 6.0 | +7 | +285 | 15 | +265 | 93 |
| | | | | −7 | −125 | 15 | −100 | |
| 85 | 40 | 2.0 | 6.3 | +7 | +200 | 20 | +180 | 91 |
| | | | | −7 | −60 | 10 | −45 | |
| 86 | 40 | 3.0 | 7.2 | +7 | +110 | 10 | +100 | 89 |
| | | | | −7 | −25 | 5 | −20 | |

Significant reduction in the residual voltage was obtained with the combination of the charge injection enabling particles and the charge transport molecule. Best results were obtained with negative corona charging. The percent transmission was determined after the overcoating was applied to a polyester film (Mylar, available from E. I. duPont Co.) by means of the equipment and method described in Examples 1–4.

EXAMPLES 87–92

The procedures and materials of Examples 81–86 were repeated except that $TiO_2$ particles (Titanox-2081, in which 99.99 percent have a particle size less than 44 micrometers available from N. L. Industries, Hightown, N.J.) were substituted for the $Fe_3O_4$ particles. Overcoating compositions with and without the charge transport molecule and with varying amounts of the charge injection enabling particles are compared in the examples below:

| EXAMPLES | WEIGHT PERCENT DIAMINE LOADING | ADDITIVE PARTICLE-TYPE | WEIGHT PERCENT ADDITIVE | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|---|
| 87 | 40 | $TiO_2$ | 5 | 6.0 | +7 | +500 | 10 | +415 |
| | | | | | −7 | −525 | 5 | −515 |
| 88 | 40 | $TiO_2$ | 10 | 6.3 | +7 | +260 | 10 | +245 |
| | | | | | −7 | −230 | 10 | −220 |
| 89 | 40 | $TiO_2$ | 20 | 6.3 | +7 | +60 | 5 | +50 |
| | | | | | −7 | −65 | 3 | −60 |
| 90 | 0 | $TiO_2$ | 5 | 4.7 | +7 | +700 | 17 | +540 |
| | | | | | −7 | −600 | 10 | −580 |
| 91 | 0 | $TiO_2$ | 10 | 5.3 | +7 | +360 | 0 | +330 |
| | | | | | −7 | −310 | 5 | −300 |
| 92 | 0 | $TiO_2$ | 20 | 7.3 | +7 | +100 | 0 | +100 |
| | | | | | −7 | −85 | 0 | −85 |

Significant reduction in the residual voltage was obtained with the combination of the charge injection enabling particles and the charge transport molecule.

EXAMPLES 93–98

The procedures and materials of Examples 87–92 were repeated except that ZnO particles (HC-238, particle size about 0.8 micrometer, available from New Jersey Zinc Co., Bethlehem, Pa.) were substituted for the $TiO_2$ particles. These particles have an electrical rersistivity in the order of $10^3$ ohm-cm when compacted at 2,000 p.s.i. Overcoating compositions with and without the charge transport molecule and with varying amounts of the charge injection enabling particles are compared in the examples below:

| EXAMPLES | WEIGHT PERCENT DIAMINE LOADING | ADDITIVE PARTICLE-TYPE | WEIGHT PERCENT ADDITIVE | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|---|
| 93 | 40 | ZnO | 5 | 7.3 | +7 | +340 | 30 | +300 |
| | | | | | −7 | −165 | 5 | −160 |
| 94 | 40 | ZnO | 10 | 8.0 | +7 | +200 | 20 | +170 |
| | | | | | −7 | −110 | 5 | −100 |
| 95 | 40 | ZnO | 20 | 7.3 | +7 | +80 | 5 | +65 |
| | | | | | −7 | −55 | 5 | −55 |
| 96 | 0 | ZnO | 5 | 6.3 | +7 | +440 | 0 | +430 |
| | | | | | −7 | −525 | 5 | −520 |
| 97 | 0 | ZnO | 10 | 5.7 | +7 | +420 | 0 | +410 |
| | | | | | −7 | −462 | 2 | −460 |
| 98 | 0 | ZnO | 20 | 6.0 | +7 | +185 | 3 | +175 |
| | | | | | −7 | −140 | 0 | −140 |

| EXAMPLES | WEIGHT PERCENT DIAMINE | WEIGHT PERCENT $MoS_2$ | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 99 | 40 | 0 | 8.3 | +7 | >1000 | 0 | >1000 |
| | | | | −7 | <−1000 | 0 | <−1000 |
| 100 | 40 | 0.5 | 10.3 | +7 | +700 | 35 | +650 |
| | | | | −7 | −85 | 10 | −60 |
| 101 | 40 | 1.0 | 9.0 | +7 | +400 | 20 | +370 |
| | | | | −7 | −22 | 2 | −20 |
| 102 | 40 | 2.0 | 7.3 | +7 | +285 | 20 | +265 |
| | | | | −7 | −15 | 0 | −15 |
| 103 | 0 | 0.5 | 10.0 | +7 | >1000 | 0 | >1000 |
| | | | | −7 | >−1000 | 0 | >−1000 |
| 104 | 0 | 1.0 | 6.5 | +7 | +785 | 5 | +780 |
| | | | | −7 | −920 | 15 | −900 |
| 105 | 0 | 2.0 | 8.3 | +7 | +800 | 0 | +680 |
| | | | | −7 | −795 | 15 | −775 |

Significant reduction in the residual voltage was obtained with the combination of the charge injection enabling particles and the charge transport molecule.

EXAMPLES 99-105

The procedures and materials described with respect to Examples 57-62 were repeated except that $MoS_2$ particles (Cerac-M-1104, having an average particle size of about 1 micrometer, available from Cerac, Inc., Milawaukee, Wis.) were substituted for the fluorinated graphite particles. Coating compositions with and without the charge transport molecules and with varying amounts of charge injection enabling particles are compared below:

Significant reduction of residual voltage was observed for the combination of the charge transport molecule and charge injection enabling particles. Best results were obtained with negative corona charging.

EXAMPLES 106-114

The procedures and materials described with respect to Examples 51-56 were repeated except that silicon powder was substituted for the graphite particles. Coating compositions with and without the charge transport molecules, with varying amounts of charge injection enabling particles and without both the charge transport molecules and charge injection enabling particles are compared below:

| EXAMPLES | WEIGHT PERCENT DIAMINE | WEIGHT PERCENT SILICON POWDER | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 106 | 40 | 0.5 | 8.3 | +7 | +390 | 15 | +365 |
| | | | | −7 | −145 | 5 | −120 |
| 107 | 40 | 1.0 | 7.7 | +7 | +330 | 30 | +290 |
| | | | | −7 | −115 | 15 | −90 |
| 108 | 40 | 2.0 | 6.3 | +7 | +175 | 10 | +160 |
| | | | | −7 | −55 | 10 | −55 |
| 109 | 40 | 3.0 | 7.0 | +7 | +140 | 10 | +125 |
| | | | | −7 | −60 | 0 | −60 |
| 110 | 0 | 0.5 | 5.0 | +7 | +620 | 10 | +575 |
| | | | | −7 | −705 | 5 | −695 |
| 111 | 0 | 1.0 | 5.8 | +7 | +560 | 5 | +485 |
| | | | | −7 | −600 | 5 | −595 |
| 112 | 0 | 2.0 | 5.8 | +7 | +620 | 5 | +525 |
| | | | | −7 | −680 | 15 | −640 |
| 113 | 0 | 0 | 6.7 | +7 | >+1000 | 0 | >+1000 |
| | | | | −7 | <−1000 | 0 | <−1000 |

-continued

| EXAMPLES | WEIGHT PERCENT DIAMINE | WEIGHT PERCENT SILICON POWDER | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 114 | 0 | 3.0 | 5.5 | +7 | +405 | 5 | +395 |

Significant reduction of residual voltage was observed for the combination of the charge transport molecule and charge injection enabling particles. In Example 113, the charge level and residual voltage for a composition with neither the charge transport molecules nor the charge injection enabling particles shows the insulating nature of the coating without such additives. Best results were obtained with negative corona charging.

EXAMPLES 115–117

The procedures and materials described with respect to Examples 1–4 were repeated except that colloidal silica particles having about 70 percent of the surface treated with a silane (Aerosil R-972, available from Degusa Corp., Teterboro, N.J.) was substituted for the carbon black particles. The electrical resistivity of Aerosil R-972 was about $10\times10^{12}$ ohm-cm at a packed density of about 50 to about 65 kilograms/$m^3$ according to the manufacturer's data sheet. Coating compositions with about 40 percent by weight diamine based on the weight of the polycarbonate resin and varying amounts of charge injection enabling particles are compared below:

| EXAMPLES | WEIGHT PERCENT SILICA | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|
| 115 | 0 | 6.7 | +7 | +860 | 40 | +800 |
| | | | −7 | −975 | 15 | −930 |
| 116 | 40 | 7.3 | +7 | +220 | 25 | +180 |
| | | | −7 | −100 | 20 | −80 |
| 117 | 50 | 10.5 | +7 | +420 | 55 | +340 |
| | | | −7 | −60 | 5 | −50 |

Significant reduction of residual voltage was observed for the combination of the charge transport molecule and charge injection enabling particles. Best results were obtained with negative corona charging. The coatings of Examples 116 and 117 were opaque when examined as coatings on transparent polyester webs.

EXAMPLES 118–122

The procedures and materials described with respect to Examples 1–4 were repeated except that colloidal silica particles treated with a silane containing 8 carbon atoms (Aerosil R-805, available from Degusa Corp., Teterboro, N.J.) were substituted for the carbon black particles in Examples 119 and 120 and colloidal silica particles with about 90–95 percent of the surface treated with a trifunctional silane (Aerosil R-812, available from Degusa Corp., Teterboro, N.J.) were substituted for the carbon black particles in Examples 121 and 122. Coating compositions with about 40 percent by weight diamine based on the weight of the polycarbonate resin and varying amounts of charge injection enabling particles are compared below:

| EXAMPLES | WEIGHT PERCENT SILICA | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|
| 118 | 0 | 8.0 | +7 | +980 | 40 | +920 |
| | | | −7 | >−1000 | 5 | −995 |
| 119 | 40 | 8.7 | +7 | +250 | 40 | +180 |
| | | | −7 | −150 | 30 | −100 |
| 120 | 50 | 11.7 | +7 | +80 | 18 | +60 |
| | | | −7 | −40 | 10 | −25 |
| 121 | 40 | 6.7 | +7 | +340 | 40 | +270 |
| | | | −7 | −280 | 40 | −210 |
| 122 | 50 | 15.0 | +7 | +65 | 3 | +62 |
| | | | −7 | −75 | 10 | −55 |

Significant reduction of residual voltage was observed for the combination of the charge transport molecule and charge injection enabling particles. Best results were obtained with negative corona charging. The coatings of Examples 120 and 122 were very white.

EXAMPLES 123–125

The procedures and materials described with respect to Examples 118–122 were repeated except that the coating compositions contained about 40 percent by weight colloidal silica particles treated with a silane containing 8 carbon atoms (Aerosil R-805), colloidal silica particles having about 70 percent of the surface treated with a silane (Aerosil R-972) or colloidal silica particles with about 90–95 percent of the surface treated with a trifunctional silane (Aerosil R-812) were employed in coatings that did not contain a charge transport molecule. These coating compositions are compared below:

| EXAMPLES | SILICA TYPE | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|
| 123 | R805 | 5 | +7 | +750 | 70 | +640 |
| | | | −7 | −710 | 70 | −600 |
| 124 | R972 | 6.3 | +7 | +880 | 70 | +780 |
| | | | −7 | −850 | 70 | −700 |
| 125 | R812 | 7.0 | +7 | >1000 | — | >1000 |
| | | | −7 | >−1000 | — | >−1000 |

The difference between the original charge level and the residual voltage was only slight in Examples 123 and 124 and negligible in Example 125. This clearly demonstrates the synergistic effects of the combination of the charge transport molecule and charge injection enabling particles.

EXAMPLES 126–131

Various coating composition batches were prepared by milling for 48 hours in a roll mill, a polycarbonate resin (Makrolon 5705) available from Mobay Chemical Corporation, and about 94 weight percent of methylene chloride, based on the weight of the polycarbonate resin, about 40 percent by weight based on the total weight of the polycarbonate resin of N,N'-diphenyl-N,N'-bis(3-methylphenyl) 1,1'-biphenyl-4,4'-diamine and various concentrations of particles of an indium and tin oxide mixture. The amount of particles of an indium and tin oxide mixture added was based on total combined weight of the polycarbonate resin and N,N'-diphenyl-N,N'-bis(3-methylphenyl) 1,1'-biphenyl-4,4'-diamine. The particles of indium and tin oxide mixture (type 5582/1) in Examples 126–128 had a resistivity of about 0.3 ohm-cm and APS Fisher particle size of about 1.65 micrometers and the particles of indium and tin oxide mixture (type 5582/2) in Examples 129–131 and a resistivity of about 0.15 ohm-cm and APS Fisher particle size of about 1.92 micrometers. The materials (binder, charge injection enabling particles and charge transport molecule) were placed in a 4 ounce glass jar, half filled with 9 millimeter glass beads and placed on a Norton Chemical Process Products Division roll mill. The coating composition was applied to brush grained aluminum sheets by means of a Gardner Draw Bar Coater (available from Pacific Scientific) equipped with a coating bar with a 2 mil gap for depositing a wet film thickness which upon drying yields the coating thickness listed in the table, and dried overnight at ambient temperature to form coatings containing the diamine dissolved in the polycarbonate resin binder with various concentrations of particles of indium and tin oxide uniformly dispersed throughout the deposited coating. The results of physical and electrical tests on the coated aluminum sheets are set forth below:

| EXAMPLES | INDIUM TIN OXIDE TYPE | WEIGHT PERCENT LOADING | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 126 | 5582/1 | 5 | 5.3 | +7 | +360 | 15 | +340 |
| | | | | −7 | −130 | 10 | −120 |
| 127 | 5582/1 | 10 | 6.7 | +7 | +200 | 5 | +190 |
| | | | | −7 | −65 | 5 | −60 |
| 128 | 5582/1 | 20 | 5.3 | +7 | 60 | 5 | +60 |
| | | | | −7 | −20 | 2 | −18 |
| 129 | 5582/2 | 5 | 7.0 | +7 | +380 | 10 | +362 |
| | | | | −7 | −180 | 10 | −160 |
| 130 | 5582/2 | 10 | 5.0 | +7 | +220 | 10 | +205 |
| | | | | −7 | −75 | 10 | −60 |
| 131 | 5582/2 | 20 | 6.5 | +7 | +80 | 10 | +60 |
| | | | | −7 | −18 | 2 | −16 |

Significant reduction of residual voltage was observed for the combination of the charge transport molecule and charge injection enabling particles. Best results were obtained with negative corona charging.

EXAMPLES 132–137

The procedures and materials described with respect to Examples 126–131 were repeated except that the coating compositions did not contain a charge transport molecule. The particles of indium and tin oxide mixture in Examples 132–134 had a resistivity of about 0.3 ohm-cm and the particles of indium and tin oxide mixture in Examples 135–137 had a resistivity of about 0.15 ohm-cm. These coating compositions are compared below:

| EXAMPLES | INDIUM TIN TYPE | WEIGHT PERCENT LOADING | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 132 | 5582/1 | 5 | 5 | +7 | +530 | 5 | +525 |
| | | | | −7 | −670 | 10 | −630 |
| 133 | 5582/1 | 10 | 6 | +7 | +438 | 1 | +437 |
| | | | | −7 | −430 | 5 | −410 |
| 134 | 5582/1 | 20 | 4.7 | +7 | +340 | 0 | +335 |
| | | | | −7 | −280 | 0 | −280 |
| 135 | 5582/2 | 5 | 5.0 | +7 | +545 | 5 | +520 |
| | | | | −7 | −675 | 10 | −640 |
| 136 | 5582/2 | 10 | 6.7 | +7 | +535 | 5 | +505 |
| | | | | −7 | −640 | 2 | −610 |

-continued

| EXAMPLES | INDIUM TIN TYPE | WEIGHT PERCENT LOADING | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 137 | 5582/2 | 20 | 5.5 | +7 | +220 | 0 | +220 |
| | | | | −7 | −205 | 0 | −205 |

The difference between the original charge level and the residual voltage was only slight in Examples 132–136 and negligible in Example 137. The reduction in voltage from coatings without charge transport molecules and charge injection enabling particles, such as Example 113, clearly demonstrates the synergistic effects of the combination of the charge transport molecule and charge injection enabling particles.

EXAMPLES 138–174

The procedures and materials described with respect to Examples 126–131 were repeated except that $SnO_2/Sb_2O_3$ pigment having an 85/15 weight ratio of Sn/Sb (available from Mitsubishi Metals Limited, Japan) was substituted for the indium and tin oxide mixture. Coating compositions with various amounts by weight diamine based on the weight of the polycarbonate resin and varying thicknesses of the overcoating are compared below:

| EXAMPLES | WEIGHT PERCENT DIAMINE | WEIGHT PERCENT $S_nO_2/Sb_2O_3$ | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 138 | 20 | 8 | 2.7 | +7 | +80 | 0 | +80 |
| | | | | −7 | −20 | 0 | −20 |
| 139 | 20 | 8 | 5.5 | +7 | +115 | 5 | +110 |
| | | | | −7 | −25 | 0 | −20 |
| 140 | 20 | 8 | 12.0 | +7 | +105 | 5 | +100 |
| | | | | −7 | −20 | 0 | −20 |
| 141 | 30 | 8 | 6.3 | +7 | +75 | 5 | +70 |
| | | | | −7 | −5 | 0 | −5 |
| 142 | 30 | 8 | 6.8 | +7 | +60 | 2 | +58 |
| | | | | −7 | −0 | 0 | −0 |
| 143 | 30 | 8 | 13.0 | +7 | +60 | 0 | +58 |
| | | | | −7 | −5 | 0 | −5 |
| 144 | 40 | 8 | 3.0 | +7 | +45 | 0 | +45 |
| | | | | −7 | −15 | 0 | −45 |
| 145 | 40 | 8 | 6.2 | +7 | +60 | 0 | +60 |
| | | | | −7 | −10 | 0 | −5 |
| 146 | 40 | 8 | 13.2 | +7 | +58 | 6 | +50 |
| | | | | −7 | −10 | 0 | −10 |
| 147 | 20 | 10 | 2.3 | +7 | +60 | 0 | +58 |
| | | | | −7 | −10 | 0 | −10 |
| 148 | 20 | 10 | 6.0 | +7 | +80 | 0 | +80 |
| | | | | −7 | −10 | 0 | −10 |
| 149 | 20 | 10 | 14.3 | +7 | +95 | 10 | +85 |
| | | | | −7 | −15 | 3 | −12 |
| 150 | 30 | 10 | 3.7 | +7 | +55 | 0 | +50 |
| | | | | −7 | −5 | 0 | −5 |
| 151 | 30 | 10 | 7.5 | +7 | +50 | 5 | +45 |
| | | | | −7 | −15 | 0 | −10 |
| 152 | 30 | 10 | 14.3 | +7 | +60 | 0 | +60 |
| | | | | −7 | −5 | 0 | −5 |
| 153 | 40 | 10 | 4.5 | +7 | +40 | 6 | +40 |
| | | | | −7 | −5 | 0 | −5 |
| 154 | 40 | 10 | 7.5 | +7 | +58 | 1 | +57 |
| | | | | −7 | −5 | 0 | −5 |
| 155 | 40 | 10 | 13.0 | +7 | +62 | 2 | +60 |
| | | | | −7 | −10 | 0 | −5 |
| 156 | 20 | 12 | 5.8 | +7 | +55 | 2 | +57 |
| | | | | −7 | −5 | 0 | −5 |
| 157 | 20 | 12 | 6.7 | +7 | +65 | 5 | +60 |
| | | | | −7 | −5 | 0 | −5 |
| 158 | 20 | 12 | 12.0 | +7 | +60 | 2 | +63 |
| | | | | −7 | −20 | 2 | −18 |
| 159 | 30 | 12 | 2.8 | +7 | +40 | 0 | +35 |
| | | | | −7 | −5 | 0 | −5 |
| 160 | 30 | 12 | 9.2 | +7 | +50 | 5 | +45 |
| | | | | −7 | −35 | 0 | −35 |
| 161 | 30 | 12 | 14.5 | +7 | +42 | 1 | +40 |
| | | | | −7 | −5 | 0 | −5 |
| 162 | 40 | 12 | 3.2 | +7 | +35 | 5 | +30 |
| | | | | −7 | −5 | 0 | −5 |
| 163 | 40 | 12 | 7.5 | +7 | +35 | 0 | +35 |
| | | | | −7 | −5 | 0 | −5 |
| 164 | 40 | 12 | 14.0 | +7 | +60 | 0 | +60 |
| | | | | −7 | −5 | 0 | −5 |
| 165 | 40 | 0 | 7.0 | +7 | >+1000 | — | >+1000 |

-continued

| EXAMPLES | WEIGHT PERCENT DIAMINE | WEIGHT PERCENT $S_nO_2$/ $Sb_2O_3$ | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| | | | | −7 | <−1000 | — | <−1000 |
| 166 | 0 | 8 | 4.5 | +7 | +307 | 2 | +300 |
| | | | | −7 | −240 | 0 | −235 |
| 167 | 0 | 8 | 8.0 | +7 | +420 | 5 | +405 |
| | | | | −7 | −355 | 10 | −345 |
| 168 | 0 | 8 | 9.3 | +7 | +595 | 10 | +565 |
| | | | | −7 | −660 | 3 | −645 |
| 169 | 0 | 10 | 4.7 | +7 | +280 | 0 | +270 |
| | | | | −7 | −220 | 0 | −220 |
| 170 | 0 | 10 | 6.0 | +7 | +270 | 5 | +250 |
| | | | | −7 | −220 | 0 | −215 |
| 171 | 0 | 10 | 11.0 | +7 | +405 | 5 | +395 |
| | | | | −7 | −350 | 10 | −340 |
| 172 | 0 | 12 | 3.6 | +7 | +145 | 0 | +142 |
| | | | | −7 | −100 | 0 | −100 |
| 173 | 0 | 12 | 5.5 | +7 | +190 | 5 | +190 |
| | | | | −7 | −150 | 5 | −145 |
| 174 | 0 | 12 | 11.3 | +7 | +260 | 0 | +260 |
| | | | | −7 | −215 | 5 | −210 |

Significant reduction of the charge level and residual voltage was observed for the combination of the charge transport molecule and charge injection enabling particles in Examples 138–164 compared to Examples 165–174 in which either the charge transport molecule or charge injection enabling particles were omitted. Best results were obtained with negative corona charging.

EXAMPLES 175–185

Various coating composition batches were prepared by milling for 48 hours in a roll mill, carbon black (Monarch 1300) available from Cabot Corporation, methylene chloride, various binders, and various transport additives. About 1 percent by weight carbon black was added based on total combined weight of the binder and transport additive. The carbon black had a surface ($N_2$S.A.) of about 560 square meters per gram, a particle size of about 13 millimicrons, a fixed carbon of about 90.5 percent and medium electrical resistivity relative to other carbon blacks supplied by Cabot Corporation. Elvacite 2046 is n-butyl/isobutyl methacrylate (50/50 parts by weight) copolymer available from E. I. du Pont de Nemours & Co.; Ethyl Cellulose is Type 10 available from Hercules Inc.; VYNS-3 is a copolymer of vinyl chloride and vinyl acetate available from Union Carbide Corp.; EAB171-2 is cellulose acetate butyrate available from Eastman Kodak Co.; Lustrex HF-777 is polystyrene available from Monsanto Co.; Pliolite SSD is a styrene butadiene copolymer available from Goodyear Tire & Rubber Co.; Pliolite AC-L is styrene acrylate copolymer available from Goodyear Tire & Rubber Co.; Pliolite VT-L is vinyl toluene butadiene copolymer available from Goodyear Tire & Rubber Co.; UDEL P1700 is polysulfone available from Union Carbide Corp.; Pliolite VTAC-L is vinyl toluene butadiene copolymer available from Goodyear Tire & Rubber Co.; and Ardel D-100 is polyacrylate available from Union Carbide Corp. Transport additive A is 2,5,bis(4-diethylaminophenyl)-1,3,4-oxadizole, transport additive B is N,N'-diphenyl-N,N'-bis(3-methylphenyl) 1,1'-biphenyl-4,4'-diamine and transport additive C is bis(4diethylamino-2-methylphenyl)phenyl methane. The materials (binder, charge injection enabling particles and charge transport molecule) were placed in a 4 ounce glass jar, half filled with 9 millimeter glass beads and placed on a Norton Chemical Process Products Division roll mill. The coating compositions were applied to brush grained aluminum sheets by means of a Gardner Draw Bar Coater (available from Pacific Scientific) equipped with a coating bar with a 2 mil gap for depositing a wet film thickness which upon drying yields the coating thickness listed in the table and dried in a forced air oven at 100° C. for 1 hour to form coatings. The results of physical and electrical tests on the coated aluminum sheets are set forth below:

| EXAMPLES | BINDER TYPE | TRANSPORT ADDITIVE TYPE | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| 175 | Elvacite | A | 4.7 | +7 | +100 | 5 | +95 |
| | 2046 | | | −7 | −62 | 2 | −62 |
| 176 | Ethyl | A | 6.8 | +7 | +270 | 10 | +260 |
| | Cellulose | | | −7 | −285 | 15 | −270 |
| 177 | VYNS-3 | A | 5.3 | +7 | +180 | 10 | +165 |
| | | | | −7 | −110 | 10 | −100 |
| 178 | EAB171-2 | A | 6.2 | +7 | +190 | 10 | +180 |
| | | | | −7 | −140 | 10 | −125 |
| 179 | Lustrex | B | 5.5 | +7 | +90 | 10 | +80 |
| | HF-777 | | | −7 | −40 | 2 | −38 |
| 180 | Pliolite | B | 5.3 | +7 | +170 | 5 | +160 |
| | SSD | | | −7 | −18 | 0 | −18 |
| 181 | Pliolite | B | 4.7 | +7 | +155 | 5 | +145 |
| | AC-L | | | −7 | −18 | 2 | −16 |
| 182 | Pliolite | B | 3.7 | +7 | +100 | 0 | +100 |

-continued

| EXAMPLES | BINDER TYPE | TRANS-PORT ADDITIVE TYPE | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|---|
| | VT-L | | | −7 | −20 | 2 | −18 |
| 183 | UDEL | C | 5.7 | +7 | +200 | 5 | +195 |
| | P1700 | | | −7 | −145 | 15 | −125 |
| 184 | Pliolite | B | 5.2 | +7 | +75 | 5 | +65 |
| | VTAC-L | | | −7 | −5 | 0 | −5 |
| 185 | Ardel | C | 4.7 | +7 | +340 | 15 | +320 |
| | D-100 | | | −7 | −300 | 20 | −280 |

Significant reduction of residual voltage was observed for the various combinations of the charge transport molecules, binders and charge injection enabling particles. Generally, best results were obtained with negative corona charging.

EXAMPLES 186–198

The materials and procedures described in Examples 175–185 were repeated to form coatings on brushed aluminum sheets, but without transport additive A, 2,5,bis(4-diethylaminophenyl)-1,3,4-oxadizole, transport additive B, N,N'-diphenyl-N,N'-bis(3-methylphenyl) 1,1'-biphenyl-4,4'-diamine, or transport additive C, bis(4diethylamino-2-methylphenyl)phenyl methane. Electrical measurements were made on these coated sheets with the procedures and equipment described above with reference to Examples 1–4. The results of these tests are set forth below:

| EXAMPLES | BINDER TYPE | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|
| 186 | Elvacite | 6.7 | +7 | +485 | 5 | +480 |
| | 2046 | | −7 | −600 | 30 | −570 |
| 187 | Ethyl | 10.0 | +7 | +715 | 75 | +640 |
| | Cellulose | | −7 | −650 | 70 | −580 |
| 188 | VYNS-3 | 5.0 | +7 | +400 | 0 | +400 |
| | | | −7 | −495 | 0 | −495 |
| 189 | Eastman | 4.7 | +7 | +605 | 45 | +560 |
| | EAB-171-2 | | −7 | −560 | 50 | −510 |
| 190 | Lustrex | 5.7 | +7 | +260 | 2 | +260 |
| | HF-777 | | −7 | −215 | 3 | −216 |
| 191 | Pliolite | 5.5 | +7 | +370 | 0 | +370 |
| | VTAC-L | | −7 | −340 | 0 | −340 |
| 192 | Pliolite | 5.3 | +7 | +405 | 5 | +400 |
| | SSD | | −7 | −505 | 5 | −500 |
| 193 | Pliolite | 7.0 | +7 | +495 | 0 | +495 |
| | AC-L | | −7 | −635 | 5 | −630 |
| 194 | Pliolite | 4.0 | +7 | +275 | 5 | +270 |
| | VT-L | | −7 | −235 | 0 | −235 |
| 195 | UDEL | 6.3 | +7 | +450 | 15 | +435 |
| | P1700 | | −7 | −440 | 5 | −435 |
| 196 | Ardel | 6.3 | +7 | +535 | 0 | +535 |
| | D-100 | | −7 | −640 | 0 | −640 |

The difference between the residual charge level of the coatings in Examples 186–196 not containing a transport compound compared to corresponding Examples 175–185 demonstrates the marked reduction in residual voltage that results from the combination of the charge transport molecule and charge injection enabling particles.

EXAMPLES 197–202

Various coating composition batches were prepared by mixing in a paint shaker, Red Devil Model No. 5100X, available from Red Devil Inc., Union, N.J., with 3.2 millimeter diameter stainless steel shot for about 90 minutes, a polyacrylate resin (Ardel D-100, available from Union Carbide Corp.), about 94 weight percent of methylene chloride, based on the weight of the polyacrylate resin, about 35 percent by weight based on the total weight of the polyacrylate resin of N,N'-diphenyl-N,N'-bis(3-methylphenyl) 1,1'-biphenyl-4,4'-diamine and various concentrations of vanadyl phthalocyanine (VPC) pigment particles. The amount of vanadyl phthalocyanine pigment particles added was based on total combined weight of the polyacrylate resin and N,N'-diphenyl-N,N'-bis(3-methylphenyl) 1,1'-biphenyl-4,4'-diamine. The coating composition was applied to brush grained aluminum sheets by means of a Gardner Draw Bar Coater (available from Pacific Scientific) equipped with a coating bar with a 2 mil gap for depositing a wet film thickness which upon drying yields the coating thickness listed in the table, and dried in a forced air oven at about 120° C. for about 1 hour to form coatings containing the diamine dissolved in the polyacrylate resin binder with various concentrations of vanadyl phthalocyanine pigment particles (if present) uniformly dispersed throughout the deposited coating. The results of physical and electrical tests on the coated aluminum sheets are set forth below:

| EXAMPLES | WEIGHT PERCENT VPC PARTICLES | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|
| 197 | 25 | 7.5 | +7 | +125 | 23 | +102 |
| | | | −7 | −65 | 10 | −55 |
| 198 | 20 | 6.0 | +7 | 140 | 25 | +115 |
| | | | −7 | −70 | 12 | −58 |
| 199 | 15 | 6.5 | +7 | 160 | 38 | +122 |
| | | | −7 | −98 | 23 | −75 |
| 200 | 10 | 6.5 | +7 | +215 | 37 | +178 |
| | | | −7 | −122 | 24 | −98 |
| 201 | 5 | 6.0 | +7 | +258 | 43 | +215 |
| | | | −7 | −202 | 42 | −160 |
| 202 | 0 | 5.5 | +7 | +345 | 35 | +310 |
| | | | −7 | −505 | 60 | −445 |

The resulting residual voltage was reduced when the coating contained the combination of the charge transport molecules and finely divided charge injection enabling particles.

EXAMPLES 203–208

The procedures described in Examples 8–14 were repeated except that the N,N'-diphenyl-N,N'-bis(3-methylphenyl) 1,1'-biphenyl-4,4'-diamine was omitted. The results of physical and electrical tests on the coated aluminum sheets are set forth below:

| EXAMPLES | WEIGHT PERCENT VPC PARTICLES | TOTAL THICKNESS (μM) | COROTRON VOLTS (KV) | CHARGE LEVEL (V) | DARK DECAY (V/SEC) | RESIDUAL VOLTS (V) |
|---|---|---|---|---|---|---|
| 203 | 25 | 6.0 | +7 | +80 | 38 | +42 |
| | | | −7 | −20 | 2 | −18 |
| 204 | 20 | 6.5 | +7 | 138 | 56 | +82 |
| | | | −7 | −10 | 10 | −25 |
| 205 | 15 | 6.0 | +7 | 530 | 60 | +470 |
| | | | −7 | −100 | 42 | −58 |
| 206 | 10 | 6.5 | +7 | +680 | 15 | +665 |
| | | | −7 | −622 | 37 | −585 |
| 207 | 5 | 7.0 | +7 | +742 | 4 | +738 |
| | | | −7 | −742 | 22 | −720 |
| 208 | 0 | 6.5 | +7 | +810 | 10 | +800 |
| | | | −7 | −899 | 24 | −875 |

The difference between the residual charge level of the coatings in Examples 205–208 not containing a transport compound compared to corresponding Examples 199–202 demonstrates the marked reduction in residual voltage that results from the combination of the charge transport molecule and charge injection enabling particles Examples 203 and 204 corresponding to Examples 197 and 198 show very little reduction in residual voltage and is attributed to the VPC pigment functioning as a charge transporting material. The pigment absorbs light throughout the visible and IR region and at the concentrations where pigment charge transport appears to dominate, the coatings are opaque.

EXAMPLE 209

A selenium alloy photoreceptor comprising a nickel substrate, resin interface and a selenium alloy of 0.33 weight arsenic, 100 parts per million chlorine and the remainder selenium was coated by means of a Binks spray coating apparatus with blocking layer and an overcoating composition. The blocking layer contained about 1.0 gram of zirconium acetylactonate, about 1.0 gram of polyvinylbutyral (Butvar B-72 available from Monsanto Co.) dissolved in a solvent mixture of 468 grams of isopropyl alcohol (IPA) and 180 grams of isobutyl alcohol. The IPA contains about 5 percent by weight water. The resulting dried coating thickness was about 0.05 micrometers. The blocking layer was thereafter coated with an overcoating prepared by mixing on a paint shaker, Red Devil Model No. 5100X, available from Red Devil Inc., Union, N.J., with 3.2 millimeter diameter stainless steel shot for about 90 minutes, 40 Grams of a solution of 0.28 grams of Black Pearls L carbon black, about 0.07 gram Fluorad FC-430 fluorocarbon dispersant from 3M Company, about 16.6 grams polycarbonate resin (Makrolon 5705) available from Mobay Chemical Corporation, about 11.2 grams of N,N'-diphenyl-N,N'-bis(3-methylphenyl)-1,1'-biphenyl-4,4'-diamine, and 521 grams of methylene chloride and 593 grams of 1,1,2-trichloroethane. The dried spray deposited overcoating layer had a thickness of about 4 micrometers.

The overcoated photoreceptor sample was charged by a constant current corona charging device and the sample voltage measured 0.5 seconds later on a chart recorder. The sample was photodischarged by a tungsten lamp and the residual voltage was measured 2.5 seconds after charging, 0.1 second after exposure. A sample of the original uncoated photoreceptor (control) was also charged and tested in the same manner. The data from the tests of the overcoated and nonovercoated photoreceptors were compared in regard to charge acceptance ($DV_O$) and residual voltage ($DV_R$) after light erase. $V_O$ of the overcoated photoreceptor minus the $V_O$ of the unovercoated photoreceptor, i.e. $DV_O$ was 170 volts. $V_R$ of the overcoated photoreceptor minus the $V_R$ of the unovercoated photoreceptor, i.e. $DV_R$, was 100 volts. This comparison shows that the blocking layer was effective in preventing charge injection. Further, the charge acceptance was increased by the overcoat so that the device charged to a level 70 volts greater than the increase in residual voltage.

EXAMPLE 210

The procedures described in Example 209 were repeated with the same materials except that Silwet L-7500 available from Union Carbide Corp. was employed as a dispersant instead of Fluorad FC-430. The electrical measurements for this sample compared to the control sample was $DV_O=60$ volts and $DV_R=45$ volts. This comparison shows that the overcoated photoreceptor had a charge acceptance 15 volts greater than the charge level of the nonovercoated photoreceptor.

EXAMPLE 211

The procedures described in Example 209 were repeated with the same materials except that the blocking layer was omitted. The electrical measurements for this sample compared to the control sample was $DV_O=-480$ volts and $DV_R=85$ volts. This comparison shows that the overcoated photoreceptor had a charge acceptance 565 volts less than the charge level of the nonovercoated photoreceptor indicating charge injection into the the photoreceptor and that a blocking layer is required to trap charge on this photoreceptor.

EXAMPLE 212

The procedures described in Example 209 were repeated with the same materials except that a selenium-tellurium alloy photoreceptor drum from a Xerox 2830 Copier was used instead of the arsenic, chlorine, selenium alloy photoreceptor. The electrical measurements for this sample compared to the control sample was $DV_O=100$ volts and $DV_R=60$ volts. This comparison shows that the overcoated photoreceptor had a charge acceptance 40 volts greater than the charge level of the nonovercoated photoreceptor.

EXAMPLE 213

The overcoated drum described in Example 212 was installed in a Xerox 2830 Copier and cycled to make several thousand copies at ambient relative humidity and temperature conditions of 50 percent RH and 70° F. The resulting copies were clean and free of background toner deposits with image resolution of 7 line pairs per millimeter. Good sharp images were also obtained by repeating the tests at 80 percent relative humidity and 80° F. Moreover, the drum surface was free of any scratches and was easily cleaned with a wiper blade cleaner. Toner image transfer efficiency was also high and complete.

EXAMPLE 214

The procedures described in Example 209 were repeated with the same materials except that a multilayered photoreceptor was employed instead of the arsenic, chlorine, selenium alloy photoreceptor. The multilayered photoreceptor was prepared by first forming on an anodized aluminum substrate a 15 micrometer thick transport layer of 35 percent by weight based on the total weight of the polycarbonate resin of N,N'-diphenyl-N,N'-bis(3-methylphenyl) 1,1'-biphenyl-4,4'-diamine dissolved in polycarbonate resin (Merlon M-39 available from Mobay Chemical Co.). A 1 micrometer thick generator layer was formed on the transport layer. The generator layer contained 30 percent by weight vanadyl phthalocyanine pigment particles dispersed in polyester resin (PE-100 available from Goodyear Tire & Rubber Co.). The blocking layer thickness was about 0.05 micrometer and the overcoating thickness was about 6.95 micrometers. The electrical measurements for this sample compared to a control sample of unovercoated multilayered photoreceptor was $DV_O=-180$ volts and $DV_R=40$ volts. This comparison shows that the overcoated photoreceptor was charged to a level about 220 volts less than the voltage of the nonovercoated photoreceptor. This is atributed to some charge leakage through the blocking layer due to incomplete coverage on the layered photoreceptor leading to pin holes in the blocking layer coating or other defects.

EXAMPLE 215

The procedure described in Example 214 was repeated with the same materials except that the blocking layer thickness was about 0.15 micrometer. The electrical measurements for this sample compared to a control sample of unovercoated multilayered photoreceptor was $DV_O=95$ volts and $DV_R=50$ volts. This comparison shows that after corona charging, the blocking layer effectively prevented charge injection from the overcoating into the layered photoreceptor once the blocking layer was applied in sufficient thickness or coverage.

EXAMPLES 216

The procedure described in Example 211 was repeated with the same materials except that a multilayered photoreceptor was employed instead of the arsenic, chlorine, selenium alloy photoreceptor. The multilayered photoreceptor was prepared by first forming on an anodized aluminum substrate a 1.2 micrometer thick generator layer containing 20 percent by weight trigonal selenium particles dispersed in polyvinylcarbazole binder. A 20 micrometer thick transport layer of 50 percent by weight based on the total weight of the polycarbonate resin of N,N'-diphenyl-N,N'-bis(3-methylphenyl) 1,1'-biphenyl-4,4'-diamine dissolved in polycarbonate resin was formed on the generator layer. The electrical measurements for this sample compared to an unovercoated control sample of the multilayered photoreceptor was $DV_O=-80$ volts and $DV_R=10$ volts. This comparison shows that the overcoated photoreceptor was charged to a level about 70 volts less than the voltage of the nonovercoated photoreceptor. In this case, the decrease in charge acceptance is attributed to penetration of the injection enabling particle from the overcoating into the transport layer of the multilayered photoreceptor which effectively increased the thickness of the overcoating and decreased the thickness of the transport layer.

EXAMPLE 217

The procedure described in Example 215 was repeated with the same materials and electrical measurements for this sample were taken for charge and residual voltage during cycling. The charge and residual voltage during cycling were:

| CYCLE | $V_O$ | $V_R$ |
|---|---|---|
| 1 | 900 v | 50 v |
| 10 | 980 v | 100 v |
| 100 | 1,000 v | 110 v |
| 1,000 | 940 v | 110 v |

-continued

| CYCLE | $V_O$ | $V_R$ |
|---|---|---|
| 10,000 | 820 v | 100 v |

These results demonstrate the stability of charge and residual voltage during cycling of a photoreceptor having an overcoating containing a charge transport molecule and injection enabling particles.

EXAMPLE 218

A selenium photoreceptor having an aluminum substrate supporting a selenium alloy layer of 99.8 percent selenium, 0.2 percent arsenic and doped with 20 parts per million of chlorine, having a thickness of about 3 micrometers was overcoated with a 20 micrometer thick layer containing about 40 percent by weight N,N'-diphenyl-N,N'-bis(3-methylphenyl) 1,1'-biphenyl-4,4'-diamine dissolved in polycarbonate resin (Makrolon, available from Mobay Chemical Co.). Another sample was prepared in the same manner and with the same materials but also containing about 1 percent by weight carbon black Monarch 1300, available from Cabot Corporation) in the overcoating. Both samples were then coated with another thin layer of selenium alloy layer of 99.8 percent selenium, 0.2 percent arsenic and doped with 20 parts per million of chlorine to provide a generation site for charges at the top surface of the overcoat. These samples were exposed with a less than 1 nanosecond pulse from a pulsed nitrogen laser which discharged less than 10 percent of the applied charge deposited by corona charging. The sample which did not contain the carbon black particles charged to a high voltage and hole transit through the entire device could be easily resolved by observing the voltage at the surface of the device as a function of time after laser pulse, a technique commonly referred to as xerographic time of flight.

The sample containing carbon black in the overcoating layer developed only a small voltage under identical charging conditions and a transit time signal could not be observed. The absence of a distinct transit time signal indicates that charges were injected from the charge injection enabling particles throughout the bulk of the 20 micrometer overcoat laye and provides further evidence for the bulk transport mechanism described herein. When the transport through the thin selenium alloy layer on top was measured by resolving the charges generated by the laser on a much faster time scale, identical transit pulses were observed in both samples. Therefore, in both samples, the field developed in the upper selenium alloy layers were identical. Thus, there is no extra field in the upper selenium alloy layer due to charges distributed in the layers below containing the combination of the charge transport molecule and charge injection enabling particle. In other words, there was no negative bulk space charge in the overcoating containing the combination of the charge transport molecule and the charge injection enabling particles. This example provides evidence for the transport mechanism which allows continued polarization, injection and hole transport to cause the negative charges which are left in the charge injection enabling particles to be "bubbled up" to the surface where they recombine with the corona deposited charges. Negative charges left in the bulk of the overcoating layer would produce a different field in the top alloy layer and produce different transit pulses.

Other modifications of the present invention will occur to those skilled in the art based upon a reading of the present disclosure. These are intended to be included within the scope of this invention.

We claim:

1. An electrophotographic imaging member comprising at least one photoconductive layer and an overcoating layer comprising a film forming continuous phase comprising charge transport molecules and finely divided charge injection enabling particles dispersed in said continuous phase, said overcoating layer having a thickness between about 1 micrometer and about 15 micrometers and being substantially transparent to activating radiation to which said photoconductive layer is sensitive and substantially electrically insulating at low electrical fields.

2. An electrophotographic imaging member according to claim 1 including a blocking layer interposed between said photoconductive layer and said overcoating layer.

3. An electrophotographic imaging member according to claim 1 wherein said charge injection enabling particles have a particle size less than about 10 micrometer and less than the wavelength of light to which said photoconductive layer is sensitive.

4. An electrophotographic imaging member according to claim 1 wherein said continuous phase comprises an insulating film forming binder having said charge transport molecules dissolved or molecularly dispersed therein.

5. An electrophotographic imaging member according to claim 1 wherein said continuous phase comprises an electrically insulating charge transporting film forming binder.

6. An electrophotographic imaging member according to claim 1 wherein said charge transport molecules comprise one or more compounds having the general formula:

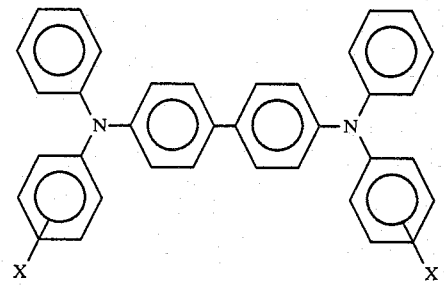

wherein X is selected from the group consisting of an alkyl group, having from 1 to about 4 carbon atoms and chlorine.

7. An electrophotographic imaging member according to claim 1 wherein said charge transport molecules comprise one or more compounds having the general formula:

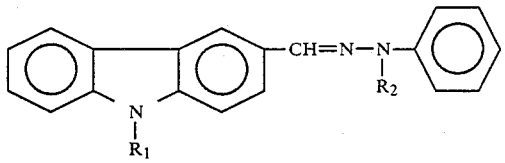

wherein $R_1$ is selected from the group consisting of a methyl, ethyl, 2-hydroxyethyl and 2-chloroethyl group and $R_2$ is selected from the group consisting of a methyl, ethyl, benzyl and phenyl group.

8. An electrophotographic imaging member according to claim 1 wherein said charge transport molecules comprise one or more compounds having the general formula:

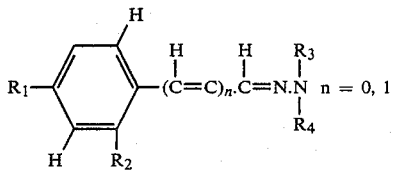

wherein $R_1$ is

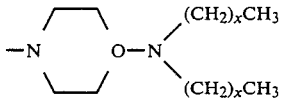

x = 0, 1, 2, 3, or

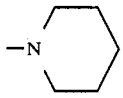

wherein $R_2$ is .$OCH_2CH_3$, .$CH_3$, or .H, wherein $R_3$ is

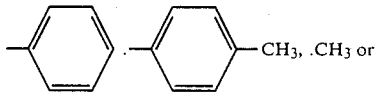

$CH_3$, .$CH_3$ or $CH_2CH_2CH_2CH_3$, and wherein $R_4$ is .

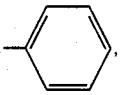

, or .$CH_3$.

9. An electrophotographic imaging member according to claim 1 wherein said charge transport molecules comprise an oxadiazole compound.

10. An electrophotographic imaging member comprising at least one photoconductive layer and an overcoating layer comprising a film forming continuous phase comprising charge transport molecules and finely divided charge injection enabling particles dispersed in said continuous phase, said overcoating layer being substantially transparent to activating radiation to which said photoconductive layer is sensitive, being substantially electrically insulating at low electrical fields, having a resistivity greater than about $10^{13}$ ohm-cm in the dark and comprising sufficient charge injection enabling particles whereby said charge injection enabling particles polarize in the dark in less than about $10^{-12}$ seconds and inject charge carriers into said continuous phase in less than about 10 microseconds in an electric field greater than about 5 volts per micrometer applied across said overcoating layer and said photoconductive layer and said charge injection enabling particles polarize in the dark in more than about $10^{-12}$ second and inject charge carriers into said continuous phase in more than about 10 microseconds in an electric field less than about 5 volts per micrometer applied across said overcoating layer and said photoconductive layer.

11. An electrophotographic imaging process comprising (a) providing an electrophotographic imaging member comprising at least one photoconductive layer and an insulating overcoating layer comprising a film forming continuous phase comprising charge transport molecules and finely divided charge injection enabling particles dispersed in said continuous phase, said overcoating layer having a thickness between about 1 micrometer and about 15 micrometers and being substantially transparent to activating radiation to which said photoconductive layer is sensitive and having an imaging surface spaced from said photoconductive layer, (b) contacting the side of said photoconductive layer spaced from said overcoating layer with a conductive substrate, (c) depositing in the dark a substantially uniform electrostatic charge on said imaging surface, and (d) applying a sufficient electric field across said electrophotographic imaging member to polarize said charge injection enabling particles whereby said charge injection enabling particles inject charge carriers into said continuous phase, said charge carriers are transported in the dark to and trapped at the interface between said photoconductive layer and said overcoating layer, and opposite space charge in said overcoating layer is relaxed by charge emission from said charge injection enabling particles to said imaging surface.

12. An electrophotographic imaging process according to claim 11 wherein said charge carriers are trapped at a blocking layer interposed between said photoconductive layer and said overcoating layer.

13. An electrophotographic imaging process according to claim 11 wherein said electric field across said electrophotographic imaging member is formed between said uniform electrostatic charge on said imaging surface and an electrically grounded conductive member contiguous to the side of said photoconductive layer opposite said overcoating layer.

14. An electrophotographic imaging process according to claim 11 wherein said overcoating layer is electrically insulating prior to and after said injection enabling particles inject charge carriers into said continuous phase and said charge carriers are transported in the dark to and trapped at the interface between said photoconductive layer and said overcoating layer.

15. An electrophotographic imaging process according to claim 11 wherein said insulating overcoating layer has a resistivity greater than about $10^{13}$ ohm-cm in the dark and comprises sufficient charge injection enabling particles whereby said charge injection enabling particles polarize in the dark in less than about $10^{-12}$ second and inject charge carriers into said continuous phase in less than about 10 microseconds in an electric field greater than about 5 volts per micrometer applied across said overcoating layer and said photoconductive layer and said charge injection enabling particles polarize in the dark in more than about $10^{-12}$ second and inject charge carriers into said continuous phase in more than about 10 microseconds in an electric field less than about 5 volts per micrometer applied across said overcoating layer and said photoconductive layer.

* * * * *